US009187697B2

(12) United States Patent
Gomez

(10) Patent No.: US 9,187,697 B2
(45) Date of Patent: Nov. 17, 2015

(54) ADVANCED COAL UPGRADING PROCESS FOR A POWER STATION

(76) Inventor: Rodolfo Antonio M. Gomez, Brompton (AU)

( * ) Notice: Subject to any disclaimer, the term of this patent is extended or adjusted under 35 U.S.C. 154(b) by 1035 days.

(21) Appl. No.: 13/148,945

(22) PCT Filed: Nov. 17, 2010

(86) PCT No.: PCT/AU2010/001547

§ 371 (c)(1),
(2), (4) Date: Aug. 10, 2011

(87) PCT Pub. No.: WO2011/047446

PCT Pub. Date: Apr. 28, 2011

(65) Prior Publication Data

US 2011/0314730 A1 Dec. 29, 2011

(30) Foreign Application Priority Data

Jan. 4, 2010 (AU) ..... 2010900019
Mar. 9, 2010 (AU) ..... 2010900974
Apr. 6, 2010 (AU) ..... 2010901438
Apr. 22, 2010 (AU) ..... 2010901706

(51) Int. Cl.
*C10B 53/04* (2006.01)
*C10B 53/06* (2006.01)
(Continued)

(52) U.S. Cl.
CPC ..... *C10B 53/04* (2013.01); *C10B 19/00* (2013.01); *C10B 53/06* (2013.01); *C10G 1/00* (2013.01);
(Continued)

(58) Field of Classification Search
CPC ..... C10G 1/00; C10G 1/008; C10B 19/00; C10B 53/04; C10B 53/06
USPC ..... 208/49, 100, 402, 427
See application file for complete search history.

(56) References Cited

U.S. PATENT DOCUMENTS 4,217,201 A * 8/1980 Chervenak ..... 208/414
5,695,130 A * 12/1997 Csendes ..... 241/19
(Continued)

FOREIGN PATENT DOCUMENTS

WO 2008028256 3/2008
WO 2009048875 4/2009

*Primary Examiner* — Renee E Robinson
(74) *Attorney, Agent, or Firm* — Klauber & Jackson LLC

(57) ABSTRACT

A coal or carbonaceous material upgrading process for power station use, the process comprising a number of steps. First comminuting the coal or carbonaceous to a comminuted material. Second pre-treating the comminuted coal with a pulsing single frequency microwave and vacuum to reduce its water and oxygen content; the pre-treating stage being carried out at a temperature of up to 180 C. Third, treating the pre-treated comminuted material with a pulsing single frequency microwave energy under vacuum to optimize the volatile organic materials; the treatment stage being carried out at a temperature of up to 350 C. Next pyrolyzing the treated coal with a pulsing single frequency microwave and vacuum to produce a hot gas and a solid carbon residue; the pyrolyzing stage is carried out at a temperature of up to 720 C. The solid carbon residue can then be separated from the hot gas, the volatile organic materials condensed to produce a liquid hydrocarbon product and a gas product; and the solid material and the gas product fed to a power station to produce electricity therefrom. The microwave energy applied at each of the stages has a single frequency of 100 megahertz to 300 gigahertz, has circular polarisation, and is pulsed at a frequency of 2 to 50 kilohertz. The pre-treatment step, the treatment step, and the pyrolysis step can be done under vacuum.

16 Claims, 15 Drawing Sheets

(51) Int. Cl.

| | |
|---|---|
| ***C10G 1/00*** | (2006.01) |
| ***C10B 19/00*** | (2006.01) |
| ***C10L 9/08*** | (2006.01) |
| ***F23K 1/04*** | (2006.01) |

(52) U.S. Cl.
CPC . *C10G 1/008* (2013.01); *C10L 9/08* (2013.01); *F23K 1/04* (2013.01); *F23K 2201/1003* (2013.01); *F23K 2900/01002* (2013.01); *F23K 2900/01003* (2013.01)

(56) References Cited

U.S. PATENT DOCUMENTS

| | | | | |
|---|---|---|---|---|
| 2007/0102279 | A1 | 5/2007 | Novak | |
| 2007/0131591 | A1 | 6/2007 | Pringle | |
| 2009/0272028 | A1* | 11/2009 | Drozd et al. | 44/569 |

* cited by examiner

ADVANCED COAL UPGRADING PROCESS FOR A POWER STATION

CROSS REFERENCE TO RELATED APPLICATIONS

The present application is a National Stage Application claiming the priority of co-pending PCT Application No. PCT/AU2010/001547 filed Nov. 17, 2010, which in turn, claims priority from Australian application No. 2010900019, filed Jan. 4, 2010, Australian application No. 2010900974, filed Mar. 9, 2010, Australian application No. 2010901438, filed Apr. 6, 2010, and Australian application No. 2010901706, filed Apr. 22, 2010. Applicant claims the benefits of 35 U.S.C. §120 as to the PCT application and priority under 35 U.S.C. §119 as to the said Australian applications, and the entire disclosures of all applications are incorporated herein by reference in their entireties.

FIELD OF INVENTION

This invention relates to commercial processing of coal and other carbonaceous materials to upgrade then for power station use while obtaining useful liquid by-products.

BACKGROUND

State of Extraction of Oil and Gas from Coal

There is a great deal of attention to the extraction of oil and gas from oil shale and tar sands using conventional heating and electromagnetic energy or a combination of both. However, there is hardly any attention to the possibility that oil and gas can be produced from most coal material from low rank to high rank coals that contain volatile material. In our discovery, it seems more profitable to extract oil and gas from a coal material than selling the coal as fuel for an electric power plant. These situations occur when the carbonaceous or coal deposit contains too much ash in very fine dissemination with the carbonaceous material as to make the coal inefficient for burning in a power plant. Another reason may be that there are toxic impurities in the coal that make the coal unsuitable as a fuel for a power plant such as high contents of chlorine, sulphur, and toxic metals such as arsenic, vanadium, mercury and lead. Another reason is the coal deposit is too deep to mine economically.

Up-grading of Coal Feed to a Power Plant

There appears no commercial operation of up-grading coal feed to a power plant to extract oil from the coal before the coal is burnt in the power plant. David Jones in his U.S. Pat. No. 5,999,888 has proposed a thermal method of extracting oil from coal by using silica balls as a heat transfer agent in the pyrolysis of the coal. The pyrolysis of coal to produce liquids by conventional heating is a well known art but the liquid produced is crude oil in the C35 (heavy oil) region and there are many other coal chemicals produced, some being toxic.

Dr. Wilhelm Achim in his patent DE 33 45 563 proposed the contact of the coal with aromatic hydrocarbons such as toluene at 400 C to 600 C in counter current in several fluid bed reactors contained in a column. Dr. Achim claims a higher recovery of oil. My research suggests that fluid beds as described by Dr. Achim will be difficult to operate because at a certain point in the pyrolysis, about 300 C to 350 C, there is a sudden high evolution of gases that will make the fluid bed unstable. In my invention, I deliberately avoided the use of dense fluidized beds to carry out the microwave pyrolysis.

The SASOL process and the SHELL process gasify the coal in a water gas reaction to produce carbon monoxide and hydrogen and these gases are combined in a Fischer Tropsch process to produce petroleum fuels such as automotive diesel. The SASOL, the SHELL and similar processes totally converting the coal to liquid petroleum are not suitable for upgrading coal feed to power plants because of the low thermal efficiency in converting the coal to petroleum and relatively small amount of gas to feed to a power plant to produce electricity.

The Ignite Process processes the coal in a reactor that operates at the critical temperature of water, about 375 C. The claim of the inventor is that as much as 2 barrels of oil are produced per tonne of brown coal but the oil produced is of low quality and is suitable for mixing with marine diesel, a low grade fuel.

The Synfuel China process treats a slurry of black coal and water with catalyst that is heated to temperatures, ranging from 245 C to 295 C, producing synfuel gas of CO and $H_2$ that is then converted to petroleum using the Fischer Tropsch process. The slow kinetics of this process would be a deterrent to commercial application.

Franz Rotter in U.S. Pat. No. 4,308,103 (Dec. 29, 1981) pyrolyzed coal in a chamber fitted with rotating arms with the chamber heated by burning gas in an external chamber. The process produced solids, hydrocarbon gas, and hydrocarbon liquid. Rotter claimed his invention applied to carbonaceous material such as coal, rubber tyres, sawdust, and municipal waste.

Many other technologies to dry the coal, particularly for high moisture brown coal, prepare the brown coal to a lower moisture content to make the combustion more efficient, similar to the use of black steaming coal. An example is the hydrothermal drying of coal where the fine coal slurry is heated to more than 300 C at high pressure in a counter-current system to remove the water from the coal. Another is the Coldry process where the water is squeezed out of the coal in a cold process. The EXERGEN process treats a slurry of coal and water at high pressure and temperature greater than 300 C to remove the moisture from the brown coal. However, in Australia, the boilers are made to accept the brown coal with the high moisture and brown coal with moisture below 50% or 55% moisture is not acceptable to the existing boilers.

Microwave Processing of Coal to Extract Oil

There are many patents filed overseas and Australia on the use of microwaves to extract oil from coal but so far, none of these processes have been applied commercially. It is relatively easy to carry out small scale experiments using microwaves and then project these to commercial scale without demonstrating the successful use of microwaves in a commercial operation.

At the Wollongong University, New South Wales, in the early nineties, microwave processing of coal was carried out in a small pilot plant including the processing of coal from the Leigh Creek field of South Australia. It was claimed that lighter oil was produced compared to conventional heat pyrolysis of coal. The project was abandoned when further test of microwaving of the coal in a Canadian research organization did not confirm the results obtained at Wollongong University.

U.S. Pat. No. 3,449,213 E. Knapp et al (Jun. 10, 1969). Knapp proposed the preheating of the coal in a belt conveyor to 600 F (316 C) followed by the coal being radiated with microwave energy in another conveyor at 800 F in a partial vacuum. The coal chemical are recovered in an oil bath and then fractionated to recover the coal chemicals. A major scientific shortcoming of Knapp's process is that it does not address the removal of oxygen prior to pyrolysis.

U.S. Pat. No. 3,503,865 R. D. Stone et al (Mar. 31, 1970). This patent described the conditions where microwave higher than 1,000 megacycles is applied to bituminous coal at 100 C to 500 C and pressure of 15 to 10,000 psig in the presence of solvent such as tetralins, benzene and phenanthrenes and hydrogen. A very high conversion of 50% to liquids is claimed. The invention did not describe a commercial method of carrying out the process. This process does not address the removal of oxygen that would reduce the production of crude oil from the coal.

U.S. Pat. No. 4,419,214 V. Balint et al (Dec. 6, 1983). Balint describes a process of recovering oil or tar from material such as oil shale, or young coal ranks by subjecting microwaves in a pressure vessel with an expelling medium such as liquefied carbon dioxide or mixed hydrocarbon gases an "Aromatol." For oil shale, the microwave of 0.9 to 2.5 GHz is applied for 10 to 15 minutes at a temperature of below 200 C and a pressure of 85 to 100 bars giving a yield of 65% of the organic content of the oil shale. Balint has not described a commercial method of applying his process, and Balint does not address the removal of oxygen from the coal before pyrolysis, which is aggravated by the application of pressure during pyrolysis.

US Patent Application No. 20100096295 of Carl Everleigh, Julian Forthe, and Frank G. Pringle proposes to extract oil and gas from hydrocarbon bearing solids such as oil shale, coal, car tyres, petroleum waste within the microwave frequency of 4 GHz to 18 GHz with 4 GHZ to 12 GHz as being the preferred frequency range, with the operation performed at a pressure less than 1 atmosphere or vacuum as described by Knapp in U.S. Pat. No. 3,449,213. The microwave applied is described as variable frequency microwave (VFM) as described in U.S. Pat. Nos. 5,321,222 and 5,521,360 with the aim of applying a more uniform microwave without forming hot spots. The experimental work of Everleigh et al was concentrated on tyres, oil drill cuttings, and plastics; there was no experimental work reported on the microwave processing of coal to extract oil and gas.

Coal is a very complex material and the successful commercial extraction of good quality crude oil from coal depends not only on the application of microwaves but also in the process to carry out the extraction of oil. Coal, particularly brown coal, has large amounts of oxygen in their chemical and physical structure, and the hydrocarbon molecules are generally long chains that produce less oil that is heavy oil when pyrolyzed. The use of variable frequency microwaves to achieve uniform heating as proposed by Everleigh's and Pringles's patent application will generally produce heavy crude oil which is less valuable than light crude oil. The use of VFM will heat the coal uniformly similar to conventional heat and result in the production of less crude oil that is heavy crude oil.

Canadian Patent Application 2 611 533 (2007 Nov. 27). This application seems to be a collection of thoughts for the microwave assisted extraction of oils from tar sands, plastics, rubber, bituminous coal and biomass. My reading of this patent application is that it is a recitation of the microwave processes covered by the previous US patents described above. Further, there was no specific commercial apparatus described or claimed in this patent application.

The Science of Coal Analysis

FIG. 1 shows the proximate and ultimate analysis of an Australian steaming coal and a brown coal. The major emphasis of the present invention is brown coal due to the relatively large world reserves of this coal and the inefficient burning of this coal in power plants due to the high moisture content; however, the process appears to work better with higher rank coals. The oxygen in the volatile matter in coal may be physically or chemically bound but it would be detrimental to the production of crude oil as the oxygen in close proximity to the hydrocarbons, would react to produce carbon monoxide and carbon dioxide as soon as the reaction temperature is reached which is normally below the pyrolysis temperature of 450 C to 720 C. I have considered the following methods to remove oxygen and oxygen compounds from the coal:

1. Application of hydrogen at high pressure before heating up the coal/hydrogen mixture. The use of methane was also considered. After a few test using hydrogen, I abandoned this concept because it was difficult to place the hydrogen atom next to the oxygen atom before pyrolysis temperature is reached, and because of the expense of the hydrogen and the equipment to carry out this method of oxygen removal.
2. Application of vacuum while the coal is being irradiated with microwaves of the right characteristics. This simpleprocess is my favoured process and my experiments indicated it to be successful in removing oxygen from the coal.

The main purpose of microwaves in my invention is to break up the long chain hydrocarbon molecules that are abundant in the coal as compared to crude oil, into shorter chain molecules to produce more light crude oil that is more valuable than heavy crude oil. Instead of a variable microwave frequency, the frequency in the present invention is a single frequency to cut the long chain hydrocarbon molecules to shorter chain molecules; furthermore, the single frequency microwave is delivered to the coal charge in a pulsing mode, preferably a square wave instead of a sine wave. The effect of the pulsing would be similar to driving a nail into a piece of wood with a hammer; tapping the hammer on the nail drives the nail into the wood with less energy than driving the nail into the wood with a constant force. This microwave system is preferably fitted with an automatic tuner before the microwave is delivered to the reactor to achieve the highest possible absorption by the coal charge. In this invention, the linear microwave generated by the magnetron is preferably converted to circular polarised microwave before entering the reaction chamber to provide a more efficient action of the charge. FIG. 2 to diagrammatically describe the breaking up of long chains to shorter chain hydrocarbon molecules in the coal.

The ultimate objective of this invention is to develop simple commercial methods of economically carrying out a dry method of extracting oil from coal using electromagnetic energy.

DESCRIPTION OF THE INVENTION

In one form therefore the invention resides in a coal or carbonaceous material upgrading process for power station use, the process comprising the steps of;

(a) comminuting the coal or carbonaceous material to a comminuted material;

(b) pre-treating the comminuted material with a pulsing single frequency microwave and vacuum to reduce its water and oxygen content; the pre-treating stage being carried out at a temperature of up to 180 C;

(c) treating the pre-treated comminuted material with a pulsing single frequency microwave energy under vacuum to optimize the volatile organic materials; the treatment stage being carried out at a temperature of up to 350 C;

(d) pyrolyzing the treated coal with a pulsing single frequency microwave and vacuum to produce a hot gas and a solid carbon residue; the pyrolyzing stage being carried out at a temperature of up to 720 C;

(e) separating the solid carbon residue from the hot gas;

(f) condensing the volatile organic materials to produce a liquid hydrocarbon product and a gas product; and (g) feeding the solid material and the gas product to a power station to produce electricity therefrom.

Preferably the coal or carbonaceous material is comminuted in an intense gas vortex comminutor to produce a fine coal feed to the microwave process of minus 150 to minus 50 microns.

Preferably the comminuted material is pre-treated under a high vacuum to reduce the oxygen content.

Preferably the pre-treatment step comprises a stirred bed reactor.

Preferably the treatment step comprises a high vacuum.

Preferably the pyrolysing step comprises a high vacuum to extract oil and gas.

Preferably the pyrolysing step comprises an apparatus selected from a stirred bed reactor or a dilute fluidized reactor.

Preferably the hot gases after solids removal are condensed by an indirect method or by direct cooling with water, or an oil or a gas.

Preferably the solid material from step (d) is processed by grinding and flotation to remove incombustible particles therefrom before step (f) to produce a higher carbon content power station feed material and a high ash product.

Preferably the microwave applied at each of the stages has a single frequency of 100 megahertz to 300 gigahertz and is pulsed at a frequency of 2 to 50 kilohertz.

Preferably the pressure is a vacuum up to minus 95 kilopascals during the pre-treatment step, the treatment step, and the pyrolysis step.

The term "reducing the oxygen content" is intended to mean reducing oxygen compounds such as carbon monoxide and carbon dioxide as well as removing oxygen itself.

It will be seen that by this invention by the use of a multi-stage process with temperature limits at each stage, undesirable components can be removed at each stage. By removing these components at the lower temperatures, the ability for them to react adversely, which they would is still present, at the higher temperatures is greatly reduced.

Experimental Work

Experimental Apparatus

Large-scale laboratory tests have been carried out on a dry process for microwave extraction of the oil and tests have also been carried out on a low grade coal material from South Australia and two brown coals from the LaTrobe Valley of Victoria.

Initial Dry Microwave Process Apparatus

The apparatus consisted of a 2 litre quartz flask with 600 to 1,000 grams of minus 200 micron coal or shale inverted inside a BONN CM-1300T microwave oven fitted with 2 rotating antennae. Microwave frequency was 2450 megahertz. A vacuum line operated at 8 to 10 kPa connects the inverted flask to several condensers. Condenser A is cooled with water at 60 degrees; condenser B is cooled with water at 30 Celsius and condenser C is cooled to 0 C from a water bath with the condensers discharging into a 1 litre flask and the vacuum line leading to a water trap before the vacuum pump. Gas is recycled to the reactor by the vacuum pump with excess gas generated being stored in a gasometer.

Tests have been successfully conducted on an oil shale from Europe and oil shale from China. Several tests were carried out on a brown coal from South Australia. Results from this coal showed a recovery of about 300 litres of oil per dry tonne of coal and 49% of the light oil recovered was automotive diesel quality. Using a thermocouple located inside the reactor, light oil and water were observed to begin filling the 1 litre receptacle after the first condenser at 100 C. Dark light and heavy oil was observed to fill the 1 litre receptacle at 200 C. Foul smelling mercaptan gases were observed. In this test of the South Australian coal, 1,000 grams of wet low grade coal was tested and the products were:

Light Oil—180 grams

Greases—58 grams

The result is equivalent to an extraction of about 300 litres per dry tonne of coal. In this particular coal material, the light oil contained mostly $C_{10}$ to $C_{12}$ hydrocarbon molecules.

4-Litre Autoclave

The apparatus shown on FIG. 3 is a 4-litre PARR 316SS autoclave fitted with a stirrer and capable of 300 C and 1500 psig. Aside from the external electrical heater, this autoclave could be fitted with a 5.8 GHz×0.8 kilowatt microwave generator with variable power controls and an automatic microwave tuner to ensure maximum absorption of the microwave energy in the charge a or a similar microwave system but at 2.45 GHz. The 5.8 GHz and 2.45 GHz microwave were also capable of being pulsed up to 2.0 kilohertz. The stirrer of this apparatus was modified so that sufficiently dry fine coal can be stirred in the autoclave in an upward motion at the centre and downward motion at the sides to allow the coal particles to be irradiated by the microwaves entering at the bottom of the reactor.

The external gas product cooling circuit was also modified so that the drying of the coal in the autoclave can be achieved under vacuum while the coal is being irradiated with microwave in the autoclave. The product gas is cooled by two 20 mm dia. glass tube condensers, the first operated at 80 C and the second at 0 C. A third condenser contacts the gas with ice water before the gas goes to the vacuum pump and storage or discharge to the atmosphere through an activated carbon filter. The apparatus is operated at high vacuum of minus 90 kilopascals.

6 KW Dry Microwave Stirred Reactor

To obtain a larger oil sample for testing, a larger stirred reactor was built that simulated a commercial reactor as shown on FIG. 4. This stirred reactor mimics a commercial stirred screw reactor. The stirrer is capable of being rotated at speed from 20 rpm to 200 rpm. The apparatus is capable of taking a 4 to 8 kilogram load of coal. The unit is powered by a 6 kilowatt 2.45 MHz microwave with pulsing at 20 kilohertz. The hot gas is cooled by two indirect condensers, the first one heated to 60 to 80 C and the second condenser with ice cold water. The third condenser is direct contact with ice cold water. This apparatus is capable of 720 C and the large 2.45 MHz microwave generator is capable of quick heating of the coal charge to achieve various heating cycles. The apparatus is operated at high vacuum of minus 90 kpa.

The first test on this apparatus using a fine coal returned microwave absorptions generally in the 98 to 99% with the low a low of 95% absorption, indicating a good cavity design.

The coal used in the experiments was coal that was passed through a 200 kilowatt vortex comminutor machine to comminute it to give a size analysis of d50=103 microns as measured by an on-line particle size analyzer. Aside from grinding the coal fine, the intense vortex comminutor converted the wet coal containing as much as 45% moisture into a free-flowing coal mass so that the comminuted coal can be treated in the 4 litre and in this larger microwave reactor.

Experimental Results

The microwave characteristics are important to give the maximum absorption and give the fastest heating rate for the process of my invention. Dielectric measurements have been made on my behalf by Microwave Power Pty. Ltd. of a Victoria brown coal typical of the LaTrobe Valley brawn coal, and a South Australian low grade coal. A summary of the results are:

TABLE 1

Dielectric Measurement of Victorian Brown Coal and Lock Coal

| | Temp, C. | Dielectric Constant | Loss Factor | Penetration mm | Temp Rise Deg. C./sec. |
|---|---|---|---|---|---|
| Brown Coal | | | | | |
| 100 MHz | 25 | 6.13 | 0.58 | 312 | 6.2 |
| | 50 | 11.5 | 1.39 | 1647 | 1.5 |
| | 75 | 11.8 | 1.49 | 1582 | 1.6 |
| | 100 | 52.1 | 27.2 | 185 | 29.0 |
| | 125 | 49.1 | 31.1 | 159 | 33.2 |
| 920 MHz | 25 | 2.7 | 0.87 | 140 | 8.6 |
| | 50 | 3.0 | 0.83 | 155 | 8.1 |
| | 75 | 3.5 | 0.78 | 176 | 7.7 |
| | 100 | 15.9 | 1.13 | 259 | 11.1 |
| | 125 | 16.75 | 3.12 | 97 | 30.6 |
| | 150 | 26.8 | 6.12 | 62 | 60.1 |
| | 175 | 26.6 | 10.3 | 37 | 100.9 |
| 2450 MHz | 25 | 1.65 | 0.39 | 119.0 | 7.8 |
| | 50 | 1.91 | 0.56 | 69.0 | 14.7 |
| | 75 | 4.66 | 0.82 | 72.0 | 21.5 |
| | 100 | 21.4 | 1.53 | 83.0 | 40.0 |
| | 125 | 26.3 | 3.33 | 43.0 | 87.1 |
| | 150 | 29.9 | 4.84 | 31.0 | 126.7 |
| | 175 | 35.5 | 6.82 | 24.0 | 178.5 |
| 5800 MHz | 25 | 1.54 | 0.69 | 21.0 | 42.7 |
| | 50 | 1.69 | 0.84 | 19.0 | 51.9 |
| | 75 | 3.84 | 1.52 | 13.0 | 94.1 |
| | 100 | 7.54 | 5.84 | 5.8 | 361.7 |
| | 125 | 12.93 | 10.97 | 4.1 | 679.4 |
| | 150 | 15.16 | 13.11 | 3.7 | 811.9 |
| Lock Coal | | | | | |
| 100 MHz | 25 | 4.8 | 7.0 | 248 | 7.5 |
| | 50 | 10.3 | 2.2 | 968 | 2.4 |
| | 75 | 10.7 | 2.1 | 1058 | 2.2 |
| | 100 | 10.8 | 7.6 | 308 | 8.1 |

TABLE 1-continued

Dielectric Measurement of Victorian Brown Coal and Lock Coal

| | Temp, C. | Dielectric Constant | Loss Factor | Penetration mm | Temp Rise Deg. C./sec. |
|---|---|---|---|---|---|
| | 125 | 16.1 | 9.3 | 302 | 9.9 |
| | 150 | 29.6 | 24.3 | 162 | 26 |
| 920 MHz | 25 | 2.24 | 0.48 | 227.0 | 4.8 |
| | 50 | 2.6 | 1.02 | 118.0 | 10.0 |
| | 75 | 3.15 | 0.42 | 309.0 | 4.2 |
| | 100 | 12.3 | 1.94 | 132.0 | 19.1 |
| | 125 | 16.68 | 2.85 | 105 | 28.0 |
| | 150 | 22.75 | 8.00 | 44.0 | 78.6 |
| | 175 | 22.37 | 10.9 | 33 | 107.6 |
| 2450 MHz | 25 | 2.15 | 0.51 | 79.0 | 13.3 |
| | 50 | 2.45 | o.55 | 79.0 | 14.4 |
| | 75 | 2.50 | 0.71 | 63.0 | 18.5 |
| | 100 | 3.3 | 0.62 | 81.0 | 16.2 |
| | 125 | 8.37 | 1.21 | 66.0 | 31.6 |
| | 150 | 14.85 | 2.48 | 42.0 | 64.9 |
| | 175 | 47.95 | 13.13 | 15.0 | 343.4 |
| 5800 MHz | 25 | 2.65 | 0.67 | 28.0 | 41.5 |
| | 50 | 2.63 | 0.77 | 25.0 | 47.7 |
| | 75 | 4.43 | 1.01 | 24.0 | 62.5 |
| | 100 | 10.69 | 3.86 | 10.0 | 239.1 |
| | 125 | 15.48 | 6.6 | 7.1 | 408.7 |
| | 150 | 27.4 | 13.3 | 4.7 | 823.7 |
| | 175 | 31.49 | 16.2 | 4.2 | 1001.0 |

In the tabulation above, the frequency 5800 MHz appears to give the fastest heating rate as the reaction temperature increases to 175 C and hopefully beyond for the Victorian brown coal but the penetration decreases substantially. This demonstrates how important fine size of the coal is for the success of the process. For the Lock coal from South Australia it is possible that the 2.45 MHz may be as good if not better than 5.8 GHz at temperatures beyond 175 C but this will be known during actual testing.

Results on Lock Coal

A limited sample of the Lock Coal deposit was provided by Energy Exploration Limited. The best results at 2.45 MHz frequency are:

TABLE 2

Capillary Gas Chromatography Analysis of Lock Coal at 2.45 MHz

| Component | Identification | Light Oil-1 C-1 Mol % | Light Oil-2 C-1 (Dichloromethane) Mol % | Light Oil C-2 (Dichloromethane) Mol % | Heavy Oil C-1* Mol % |
|---|---|---|---|---|---|
| Propane minus | −C3 | 0.19 | 23.66 | 4.76 | 0.8 |
| Iso Butane | iC4 | 0.01 | 0.63 | 0.13 | 0.09 |
| Normal Butane | nC4 | 0.01 | 0.63 | 0.13 | 0.13 |
| Iso Pentane | iC5 | 0.00 | 0.43 | 0.20 | 0.51 |
| Normal Pentane | nC5 | 0.02 | 0.43 | 0.20 | 6.07 |
| Hexanes | C6 | 0.01 | 2.22 | 1.88 | 0.27 |
| Heptanes | C7 | 0.83 | 26.31 | 6.34 | 2.76 |
| Octanes | C8 | 0.35 | 2.90 | 6.72 | 2.25 |
| Nonanes | C9 | 1.17 | 1.54 | 7.74 | 3.95 |
| Decanes | C10 | 3.26 | 3.12 | 33.09 | 9.15 |
| Undecanes | C11 | 7.00 | 34.38 | 20.28 | 10.41 |
| Dodecanes | C12 | 12.91 | 20.78 | 6.78 | 8.58 |
| Tridecanes | C13 | 13.90 | 2.65 | 5.12 | 8.19 |
| Tetradecanes | C14 | 10.30 | 2.61 | 3.08 | 7.12 |
| Pentadecanes | C15 | 9.18 | 1.39 | 2.39 | 9.64 |
| Hexadecanes | C16 | 7.81 | 0.45 | 1.70 | 5.54 |
| Heptadecanes | C17 | 9.80 | 0.31 | 1.02 | 4.82 |
| Octadecanes | C18 | 5.37 | 0.21 | 0.87 | 4.18 |
| Nonadecanes | C19 | 4.22 | 0.11 | 0.57 | 3.47 |
| Eicosanes | C20 | 3.58 | 0.09 | 0.43 | 2.68 |
| Heneicosanes | C21 | 2.68 | 0.08 | 0.31 | 2.11 |
| Docosanes | C22 | 1.86 | 0.06 | 0.23 | 1.89 |
| Tricosanes | C23 | 1.45 | 0.06 | 0.21 | 1.53 |
| Tetracosanes | C24 | 1.10 | 0.06 | 0.22 | 1.28 |

TABLE 2-continued

Capillary Gas Chromatography Analysis of Lock Coal at 2.45 MHz

| Component | Identification | Light Oil-1 C-1 Mol % | Light Oil-2 C-1 (Dichloromethane) Mol % | Light Oil C-2 (Dichloromethane) Mol % | Heavy Oil C-1* Mol % |
|---|---|---|---|---|---|
| Pentacosanes | C25 | 0.98 | 0.14 | 0.41 | 1.12 |
| Hexacosanes | C26 | 0.65 | 0.06 | 0.18 | 0.82 |
| Heptacosanes | C27 | 0.52 | 0.04 | 0.18 | 0.76 |
| Octacosanes | C28 | 0.38 | 0.00 | 0.05 | 0.56 |
| Nonacosanes | C29 | 0.30 | 0.00 | 0.00 | 0.30 |
| Triacontanes plus | C30 | 0.19 | 0.00 | 0.00 | 0.20 |
| Hentriacontanes | C31 | 0.10 | 0.00 | 0.00 | 0.16 |
| Dotriacontanes | C32 | 0.05 | 0.00 | 0.00 | 0.10 |
| Tritriacontanes | C33 | 0.02 | 0.00 | 0.00 | 0.07 |
| Tetratriacontanes | C34 | 0.01 | 0.00 | 0.00 | 0.02 |
| Pentatriacontanes plus | C35 | 0.00 | 0.00 | 0.00 | 0.00 |
| Total | | 100.00 | 100.00 | 100.00 | 100.00 |
| Molecular weight Calculated | | 209.5 | 124.8 | 144.5 | 190.3 |
| Density at 60 F. Calculated | | 0.8338 | 0.7549 | 0.7849 | 0.8216 |
| Hydrocarbon Wt % in Sample | | 100.00 | 0.78 | 1.35 | 63.00 |

*It was difficult to separate all the light oil from the heavy oil fraction in Condenser 1.

After the experiment, it was noted that the sapphire microwave window of the reactor was cracked which allowed air into the reactor. The water produced was caught in Condenser 1 and 2 where the oil content of those samples were 0.78% and 1.35% respectively. Nevertheless, the amount of oil produced in this test was:

Light Oil—62 litres per dry tonne
Medium Oil—216 litres per tonne
Total Oil produced—278 litres per tonne

TABLE 3

Results on Loy Yang Victorian Brown Coal at 2.45 MHz under Vacuum-Test LYAU10

| Component | Fraction | Light Oil Mol % | Heavy Oil Mol % | Waxy Oil Mol % |
|---|---|---|---|---|
| Hexane | C6 | 6.34 | 1.07 | 2.53 |
| Heptanes | C7 | 27.53 | 4.56 | 3.53 |
| Octanes | C8 | 4.50 | 5.31 | 3.40 |
| Nonaes | C9 | 9.76 | 11.93 | 6.89 |
| Decanes | C10 | 4.70 | 13.25 | 7.76 |
| Undecanes | C11 | 3.13 | 9.70 | 7.14 |
| Dodecanes | C12 | 16.93 | 12.37 | 7.63 |
| Tridecanes | C13 | 3.56 | 6.36 | 6.56 |
| Tetradecanes | C14 | 2.25 | 6.26 | 8.34 |
| Pentadecanes | C15 | 1.58 | 5.10 | 6.57 |
| Hexadecanes | C16 | 1.29 | 2.95 | 6.04 |
| Heptadecanes | C17 | 1.76 | 3.19 | 4.87 |
| Octadecanes | C18 | 1.54 | 2.00 | 2.37 |
| Nonadcanes | C19 | 2.39 | 1.97 | 1.83 |
| Eicosanes | C20 | 3.11 | 1.21 | 1.63 |
| Heneicosanes | C21 | 1.65 | 1.21 | 1.59 |
| Docosanes | C22 | 2.02 | 1.00 | 1.59 |
| Tricosanes | C23 | 1.11 | 1.03 | 1.33 |
| Tetracosanes | C24 | 1.25 | 0.85 | 1.72 |
| Pentacosanes | C25 | 2.32 | 1.01 | 1.52 |
| Hexacosanes | C26 | 0.44 | 0.87 | 1.97 |
| Heptacosanes | C27 | 0.41 | 1.07 | 2.33 |
| Octacosanes | C28 | 0.13 | 1.22 | 2.61 |
| Nonacosanes | C29 | 0.00 | 1.27 | 1.78 |
| Triacontanes plus | C30 | 0.00 | 1.28 | 2.65 |
| Hentriacontanes | C31 | 0.00 | 0.90 | 1.87 |
| Dotriacontanes | C32 | 0.00 | 0.56 | 1.18 |
| Tritriacntanes | C33 | 0.00 | 0.38 | 0.60 |

TABLE 3-continued

Results on Loy Yang Victorian Brown Coal at 2.45 MHz under Vacuum-Test LYAU10

| Component | Fraction | Light Oil Mol % | Heavy Oil Mol % | Waxy Oil Mol % |
|---|---|---|---|---|
| Tetratriacontanes | C34 | 0.00 | 0.12 | 0.17 |
| Pentatriacontanes | C35 | 0.0 | 0.00 | 0.00 |
| Total | | 100.00 | 100.00 | 100.00 |
| Molecular Weight | | 157.3 | 186.1 | 217.7 |
| Density @ 60 F. | | 0.7983 | 0.8215 | 0.8402 |

The Petrolab analysis of the oil samples did not say that dichloromethane absorption of water was necessary so that the analysis of 100% hydrocarbon was assumed in Table 3.

The oil production of the above test is equivalent to:

Light Oil—130 litres per tonne
Heavy oil—86 litres per tonne
Waxy Oil—39 litres per tonne
Total Oil—255 litres per tonne The two components that provide energy in coal are the fixed carbon and the volatile matter which consists of hydrocarbons, oxygen, hydrogen- and other materials such as sulphur. The proximate analysis of coal defines these fractions as follows:

TABLE 4

Proximate analysis of Brown Coal and Steaming Coal

| Type of Coal | Moisture % | Volatile Matter % | Fixed Carbon % | Ash % |
|---|---|---|---|---|
| Brown Coal (Vic) | 60% | 48% | 48% | 4% |
| Steaming Coal (Lithgow, NSW) | 9% | 32% | 53% | 15% |

In the boiler of the power plant, the volatile matter and the fixed carbon are burnt to produce the steam to make electricity. In the present invention, the volatile matter is acted upon by the microwaves to produce liquid petroleum and little hydrocarbon gas while generally leaving the fixed carbon un-reacted. The products of the process of the present invention will be liquid petroleum, hydrocarbon gas with some carbon monoxide and carbon dioxide and a high carbon residue containing the fixed carbon and the ash content of the coal. The chemical composition of coal is described in the ultimate analysis as show below:

TABLE 5

Ultimate Analysis of Brown Coal and Steaming Coal

| Type of Coal | Hydrogen | Nitrogen/ Sulphur | Oxygen | Carbon | Minerals & Inorganics |
|---|---|---|---|---|---|
| Vic. Brown Coal | 5.0% | 1.0% | 25.0% | 67.0% | 2.0% |
| Lithgow Steaming Coal | 4.62% | 1.54/0.59% | 6.59% | 72.16% | 14.5% |

The purpose of the process of the present invention is to produce the maximum amount of light petroleum liquid. The first concern for the brown coal is the high oxygen content. The hydrocarbon gas analysis from one of my microwave test using brown coal from the LaTrobe Valley of Victoria as analysed by Petrolab is as follows:

TABLE 6

Gas Analysis of Brown Coal Pyrolysis with Circulating Hydrocarbon Gas

| Gas | Mol % Hazel #7 |
|---|---|
| $H_2$ | 1.39 |
| $O_2$ | 0.74 |
| $N_2$ | 4.91 |
| CO | 56.59 |
| $CO_2$ | 19.51 |
| $CH_4$ | 16.29 |
| $C_2H_6$ | 0.33 |
| $C_2H_6$ | 0.02 |
| C3$H_8$ | 0.04 |
| $iC_4H_{10}$ | 0.04 |
| $nC_4H_{10}$ | 0.02 |
| $iC_5H_{12}$ | 0.02 |
| $nC_5H_{12}$ | 0.02 |
| $C_6H_{14}$ | 0.02 |
| $C_7H_{16}$ | 0.04 |
| $C_8H_{18}$ | 0.02 |
| $C_9H_{20}$ | 0.00 |

The hydrocarbon gas analysis shows that most of the oxygen has been taken up as carbon monoxide and carbon dioxide with the nitrogen essentially unreacted. There is a significant amount of methane. The molecular weight of the gas is 28.95; the gross heating value is 369 btus/cubic feet; and the net heating value is 350 btus/cubic feet.

Removal of Oxygen by Irradiation with Microwave under Vacuum

Several tests were carried out by applying high vacuum to the coal while the coal is irradiated with single frequency of 2.45 GHz and pulsing at 20 kilohertz microwaves. The results of the gas analysis from the vacuum tests LYAU4, LYAU5, LYAU10 compared to gas analysis of Hazel #7 conducted with hydrocarbon gas recirculating are as follows:

TABLE 7

Comparison of Gas Analysis of Tests Under Vacuum

| Gas | Hazel #7 No Vacuum Mol % | LYAU4 Vacuum Mol % | LYAU5 Vacuum Mol % | LYAU10 Vacuum Mol % |
|---|---|---|---|---|
| $H_2$ | 1.39 | 0.00 | 0.00 | 0.08 |
| $O_2$ | 0.74 | 15.25 | 16.78 | 14.53 |
| $N_2$ | 4.91 | 73.31 | 1.88 | 55.12 |
| CO | 56.59 | 1.26 | 12.03 | 12.82 |
| $CO_2$ | 19.51 | 10.16 | 0.02 | 11.56 |
| $CH_4$ | 16.29 | 0.01 | 0.01 | 5.36 |
| $C_2H_6$ | 0.33 | 0.01 | 0.00 | 0.53 |
| $C_2H_6$ | 0.02 | 0.00 | 0.00 | 0.00 |
| $C_3H_8$ | 0.04 | 0.00 | 0.00 | 0.00 |
| $iC_4H_{10}$ | 0.04 | 0.00 | 0.00 | 0.00 |
| $nC_4H_{10}$ | 0.02 | 0.00 | 0.00 | 0.00 |
| $iC_5H_{12}$ | 0.02 | 0.00 | 0.00 | 0.00 |
| $nC_5H_{12}$ | 0.02 | 0.00 | 0.00 | 0.00 |
| $C_6H_{14}$ | 0.02 | 0.00 | 0.00 | 0.00 |
| $C_7H_{16}$ | 0.04 | 0.00 | 0.00 | 0.00 |
| $C_8H_{18}$ | 0.02 | 0.00 | 0.00 | 0.00 |
| $C_9H_{20}$ | 0.00 | 0.00 | 0.00 | 0.00 |
| Gross Heating Value BTU/cubic feet | 369 | 4 | 6 | 105 |

The gas samples of test LYAU4 and LYAU5 may have been taken during the early part of the pyrolysis process while LYAU10 may have been taken later but the results indicate that irradiating the coal with pulsing single frequency microwaves under vacuum is a simple but effective method of reducing the oxygen content of the coal. It is to be noted that the coal is in a very fine size.

Under the conditions above of 2.45 GHz and vacuum, about 10% of the oxygen was removed and there was substantially less carbon monoxide and carbon dioxide produced. More oxygen may be removed by using higher frequency microwaves and lengthening the oxygen removal period.

Microwave Characteristics

The microwave frequency range is defined from 300 MHz to 300 GHz. The optimum frequency for a particular coal needs to be determined by dielectric measurement but ultimately, each coal needs to be tested at selected frequencies in a laboratory apparatus and pilot plant to determine the best frequency to produce the largest amount of light crude oil with the least energy consumption. Low energy consumption is desirable because it will produce the lowest carbon dioxide per barrel of crude oil, an important parameter in climate change requirement. The microwave must also be pulsed at a frequency of 1.0 up to 50 kilohertz with the amplitude up to about 20 times the normal microwave strength during the pulsing but amplitude lasting for a very short time of several microseconds. Pulsing is preferred to be a square wave instead of a sine wave to be more effective. The intent of this pulsing is to help achieve the depolymerization described above along with the correct single microwave frequency. Depolymerization in this invention is the process of converting the long chain hydrocarbon molecules to short chain molecules.

The other desirable characteristic of the microwave is that instead of linear, the microwave has preferably circular polarisation within the reactor where the coal is being processed, be it in a fluid bed system or in a mechanically stirred system. This will allow the uniform application of the microwave energy to as many coal particles as possible in the reactor.

The microwave system is preferably fitted with an automatic tuner to improve the absorption of the microwave by the load. A target of 90 to 95% microwave absorption can be the objective of the automatic tuner although 98% plus absorption has been achieved in the 6 kW reactor. The proper installation of the wave guide leading into the reactor such as the shape, cross section dimensions, length and bends should be designed to minimize the reflection of the microwave. Short distances and uniform bend radius and sections are preferred.

The frequency and pulsing characteristics of the microwave described above are designed to achieve the breaking up of the long chain hydrocarbons in the volatile component of the coal during the microwave removal of the oxygen, pre-treatment and during the microwave pyrolysis so that more oil and more light oil is produced from the coal during the process of my invention.

I am also aware that my invention must use the minimum amount of microwave energy. Aside from matching of the frequency to the particular coal; pulsing the microwave; using an automatic tuner; using the correct dimensions of wave guides; microwave energy can be reduced by the use of conventional heat, particularly waste heat such as flue gas from the power plant, and recuperation.

The dry process of my invention may proceed in the following stages under vacuum: (1) Drying and oxygen removal (2) Pre-treatment and (3) Dry Pyrolysis.

Commercial Process

It is desirable that the commercial process and equipment to carry out the process of extracting oil from coal has the following features:

1. The coal can be ground fine using an intense gas vortex comminutor.
2. Fast reaction rates during the microwave treatment to achieve high capacity,
3. High heat thermal efficiency,
4. Low carbon dioxide production,
5. High oil production, and
6. Most oil must be light oil such as naphtha or automotive diesel.

The invention can be applied to any rank of coal mined but it is applicable particularly to processing coal that is fed into a power generation plant. This application is ideal because all the infrastructure is existing except for that necessary to carry out the process of the present invention and the gas and high carbon residue are fed to the power plant and the crude oil production provides a substantial income to the power plant operator. The amount of coal feed will need to be increased to produce the same electric power to compensate for the heat content of the crude oil produced and the heat and electrical energy used in the microwave processing of the coal.

BRIEF DESCRIPTION OF THE DRAWINGS

The invention will now be described in more detail with reference to the accompanying drawings.

DESCRIPTION OF PREFERRED EMBODIMENTS

Figure 1B:
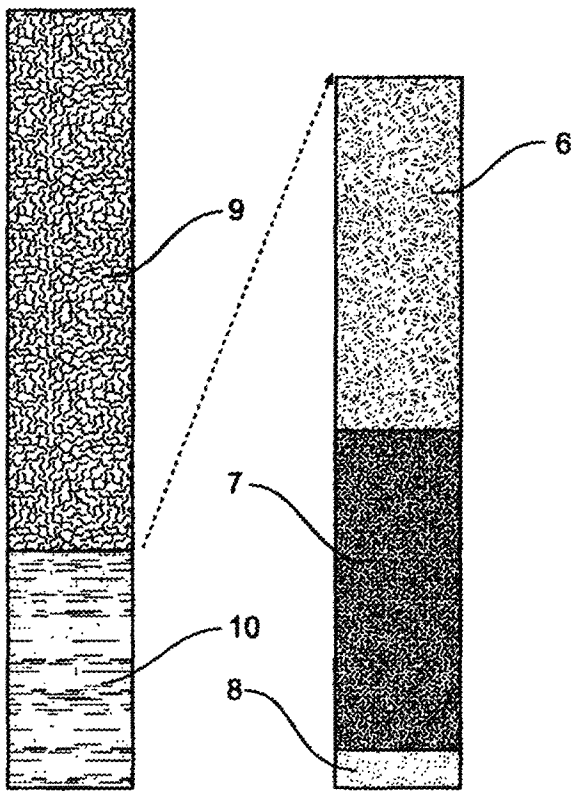
FIG. 1 shows the proximate and ultimate analysis of a New South Wales black coal and a Victorian brown coal.
Figure 1A:
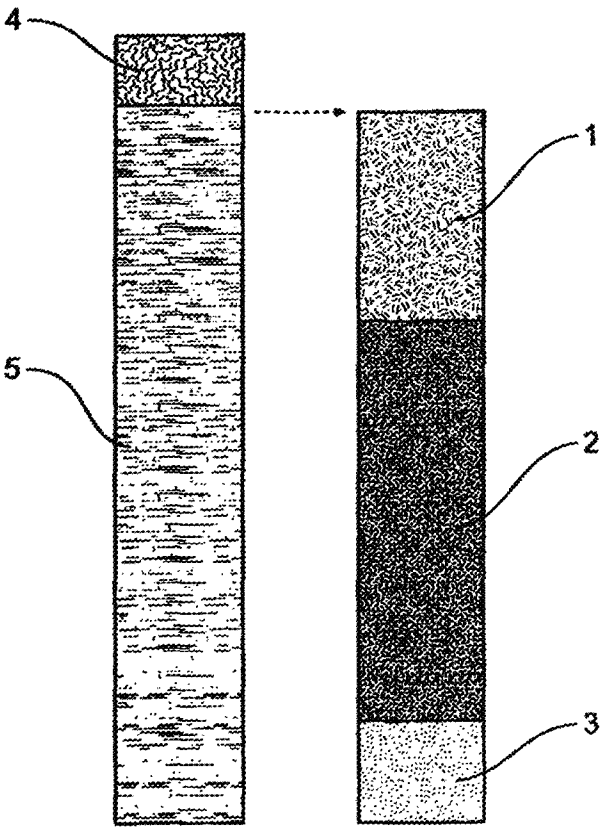

FIG. 1A shows the proximate and ultimate analysis of a New South Wales black coal and FIG. 1B a Victorian brown coal. The NSW black coal has moisture 4 of about 9% and of the non-moisture components 91%, 5, the volatile matter 1 is about 32% weight containing 10 to 15% oxygen with fixed carbon 2 of 53% and ash 3 is 15% with. The Victorian Brown coal has a moisture content 9 of about 60%, and non-moisture content 10 of about 40%. Of the non-moisture content the volatile matter 6 in Victorian brown coal is 48% with 25% oxygen and fixed carbon 7 at 48% and ash 8 of 4%.

Figure 2:
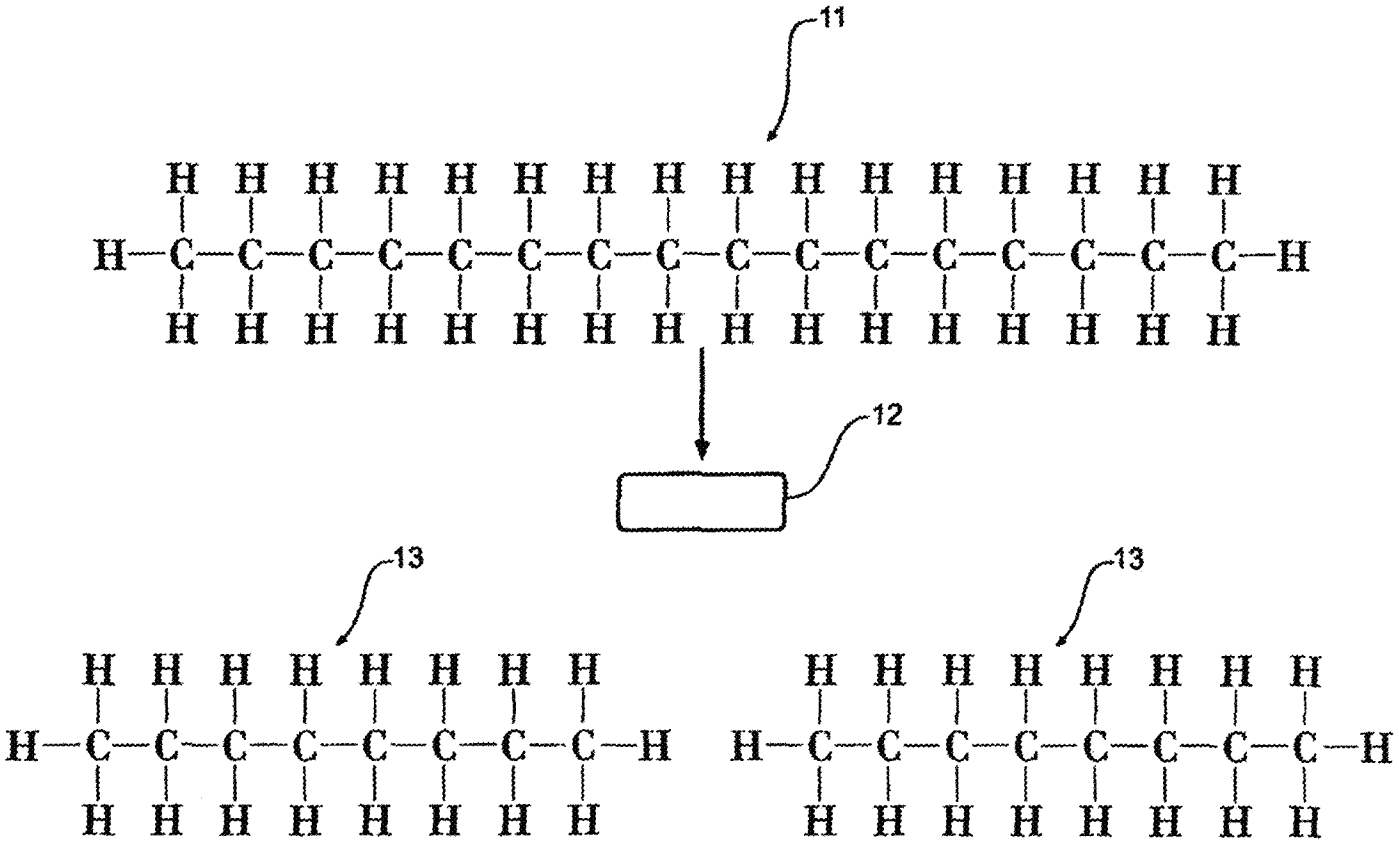
FIG. 2 is a diagram showing a concept of depolymerization of the hydrocarbon molecules in the coal.

FIG. 2 shows a diagram showing my concept of depolymerization of the hydrocarbon molecules in the coal. With higher rank coals, most of the light hydrocarbon molecules have been expelled through heat and pressure leaving only the fixed carbon and the high chain hydrocarbon molecules. In FIG. 2, long chain hydrocarbon hexadecane ($C_{16}H_{34}$), 11 is irradiated with single frequency pulsing microwave 12 under vacuum resulting in the product of two lighter hydrocarbon molecules of octane ($C_8H_{18}$) 13.

Figure 3:
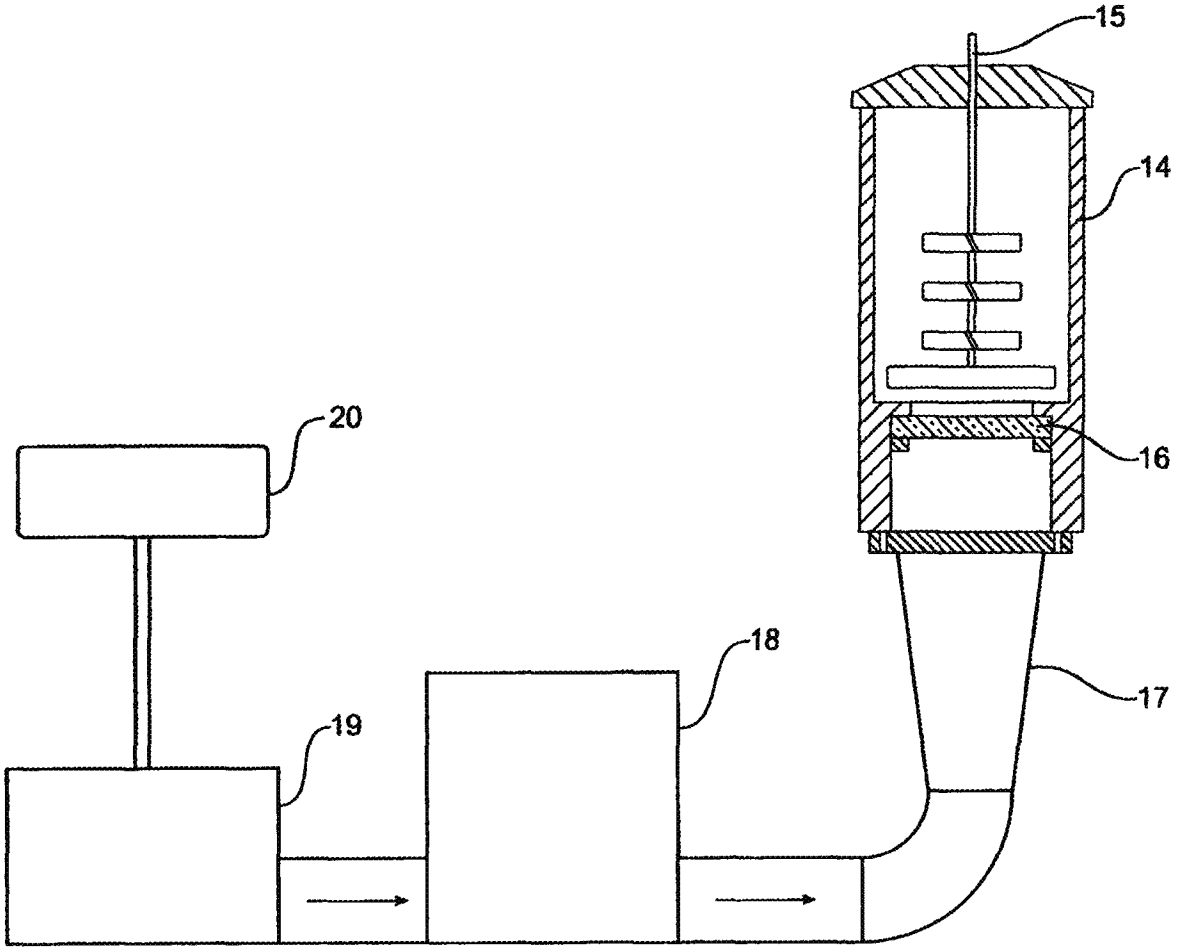
FIG. 3 shows an experimental set up according to one embodiment of the present invention.

FIG. 3 shows an experimental set up according to one embodiment of the present invention. In FIG. 3 there is shown 4 litre autoclave. The autoclave 14 is fitted with a shaft with stirrer 15 stirring the coal load and a microwave window 16 with microwaves introduced through waveguide 17 from auto tuner 18 and fed from magnetron 19 and microwave generator 20. The microwaves system is single frequency with pulsing in the microwave range of 300 MHz to 300 GHz.

Figure 4:
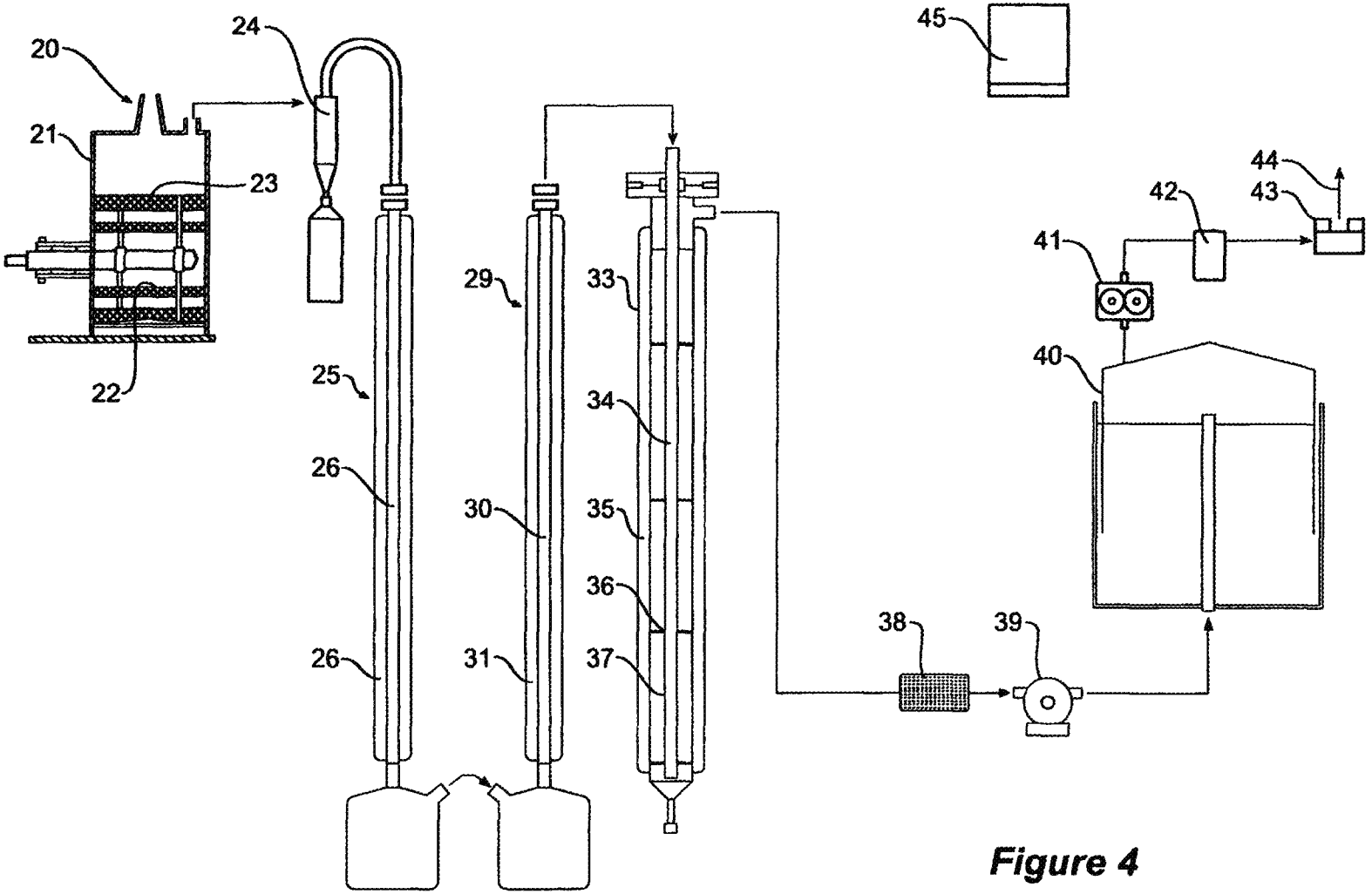
FIG. 4 shows an alternative experimental set up according to one embodiment of the present invention.

FIG. 4 shows an alternative experimental set up according to one embodiment of the present invention. In FIG. 4 a reactor 20 is fitted with a 6 kilowatt×2.45 gigahertz microwave system with pulsing at 20 kilohertz. The reactor 20 is fitted with a shaft 21 rotating slotted stainless steel sheet vanes 22 to stir the fine coal load. Microwave is admitted into the reactor 20 through circular waveguide 23 with the hot gas extracted through several outlets 24 at the top of the reactor 20 collected by exhaust pipe 25 feeding cyclone 26 with coal dust storage 27 and overflow 28 feeding condenser 29 with centre tube 31 and crude oil collected in receptacle 32 with the uncondensed gas 33 passed into receptacle 32 collecting more crude oil and the uncondensed gas passing through inner tube 36 of condenser 34 cooled by ice water 35. The uncondensed gas 37 is passed to centre tube 40 of direct condenser 38 fitted with baffles 41 to provide efficient contact between the liquid 39 and the uncondensed gas 37 to collect more crude oil and the gas exits condenser 38 through outlet 43 and conveyed by line 44 to a large filter 45 to collect oil vapour before the gas is pumped by vacuum pump 46 to gasometer 47 and gas produced is pumped by pump 48 through gas metre 49 and then to burner 42. The operation is monitored and controlled by National Instrument software in computer 30.

Figure 5:
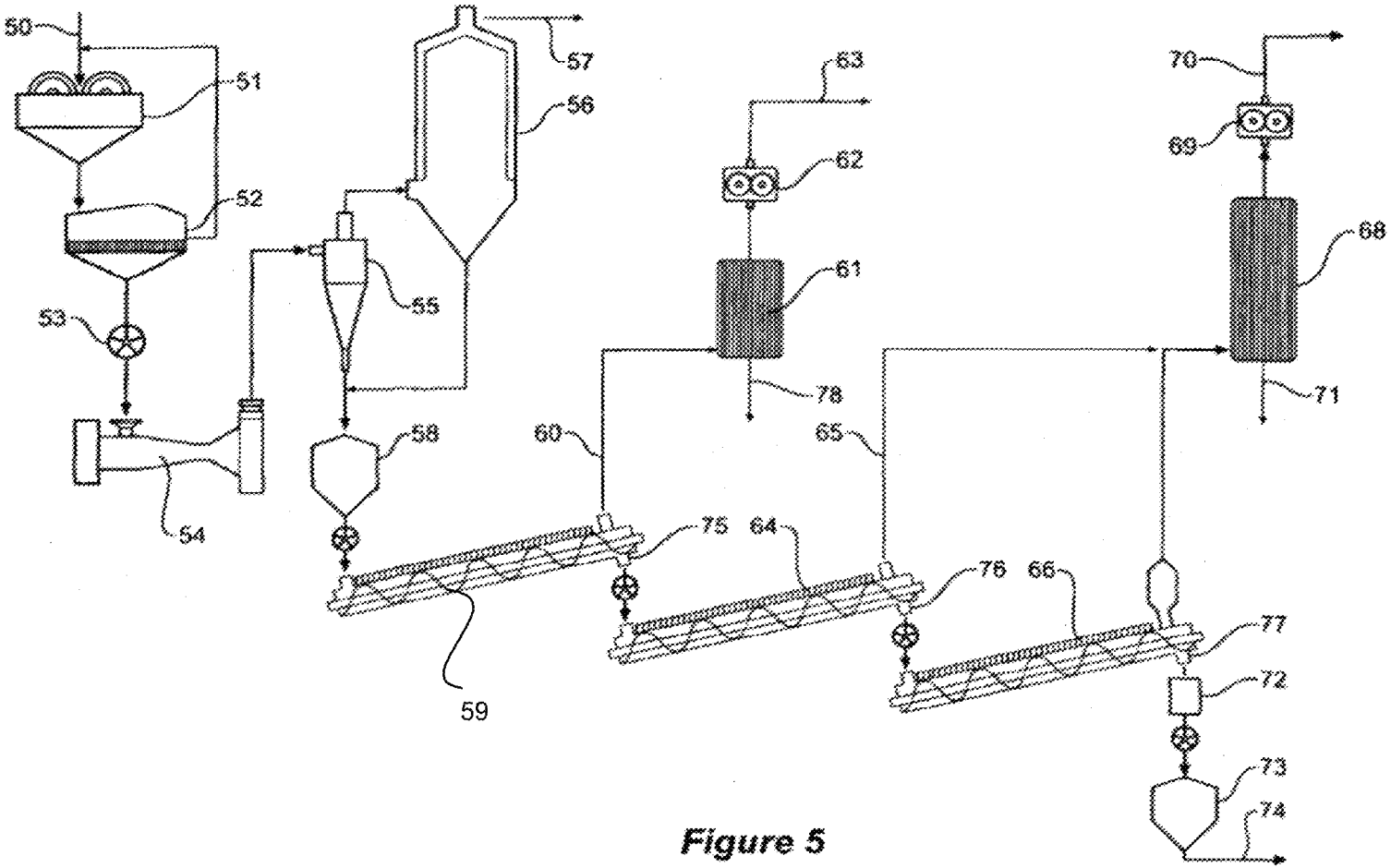
FIG. 5 shows a preferred embodiment of a commercial process according to the present invention.

The commercial microwave dry process is capable of high capacity and simplicity. A preferred dry microwave process has the following components as shown on FIG. 5.

This is a diagram of a commercial stirred bed process for oil from coal. Run of mine coal 50 is crushed in roll crusher 51 and screened by screen 52 with the crushed coal of about 6 mm size fed into an intense gas vortex comminutor 54 by feeder 53. The fine coal from the vortex comminutor 54 is fed to the primary and secondary cyclones 55 before the cyclone overflow is fed into bag house or electrostatic precipitator or wet cyclone scrubber 56 with clean air 57 exiting into the atmosphere. In many coals, hydrocarbon gas is produced upon grinding; therefore, where appropriate, the gas 57 should be used as the air feed into the boiler for environmental reasons and higher thermal efficiency of the system. Fine coal in storage bin 58 is fed into the first stirred bed reactor 59 which operates under high vacuum and microwave and heat from the flue gas of the power plant is applied to remove the moisture and oxygen from the coal with the exit temperature of the coal at about 180 C. The gas produced 60 is mostly moisture and is fed to condenser 61 and vacuum pump 62 with mostly useless gas 63 discharged to the atmosphere. The condensate 78 from condenser 61 is mostly water but this will be collected and processed if necessary for a small content of light oil or wax. The dried coal 75 is fed into the second stirred bed reactor 64 where the temperature is higher, up to 350 C, with more microwave and heat applied to de-polymerize the volatile matter in the coal. This reactor 64 may be under a pressure of 20 bars with hydrogen for the de-polymerization process but most likely reactor 64 will be under high vacuum as indicated by the experiments. The hot gas 65 from stirred reactor 64 joins the hot gas from the third reactor 66 to pass through several condensers 68 to produce the crude oil 71. The residue 76 from the reactor 64 is fed into reactor 66 where the final pyrolysis of the coal is carried out under vacuum with more microwaves and heat to result in an exit temperature of up to 720C. The hot gas from reactor 66 may pass through a solids separator 67 before proceeding to condenser 68. After passing through condenser 68, the gas is passed through vacuum pump 69 before the gas 70 is either used in this process for heating or sent to the power plant for use in the in the boiler. The residue 77 from reactor 66 is passed through recuperator 73 before it is stored in bin 73 through a valve feeder. The residue 74 is sent to the power plant or processed further to up grade its carbon content.

The first requirement is that the coal must be sufficiently fine before the microwave process is applied. This will allow fast penetration of the microwaves and speedy exit of the products from the coal particle, all leading to fast reaction rates. This is in keeping with the feature of the petroleum industry that reaction rates must be high. Dielectric measurements of several coals indicate that the higher frequency is better for my process, however, the penetration of higher frequency microwaves is much shorter, requiring finer coal particles for an efficient operation of my process. This comminution operation may require a conventional one-stage crushing and screening before the coal is fed into an intense vortex comminutor and dryer (UK Patent GB 2392117 and Aust. Patent 2002317626, US patent pending). For brown coal, the moisture is about 60% and after the intense vortex comminutor, the coal is about d80=100 microns in size with a moisture content of about 45%. At this stage, the fine coal handles well and does not stick to containing vessels or potential for spontaneous combustion; however, it is wise to note that the oxygen content of the gas in contact with the fine dry coal must not have an oxygen content more than 10% to prevent spontaneous combustion. This is achieved by using the gas produced during the pyrolysis of the coal with the process under vacuum.

Preferably the coal needs to be dried after passing through the vortex comminutor grinder-dryer. Drying may be done in a mechanically stirred dryer using microwaves as shown on FIG. 5 or in an indirect co-current dryer using flue gas from the power plant. The co-current indirect dryer may be a stirred dryer or a rotary kiln type dryer. It is expected that much of the oxygen is removed from the coal during drying using vacuum and the appropriate microwave frequency and application rate. The vapour is condensed and delivered to storage or waste pond.

The dry coal is processed in a stirred reactor (FIG. 5) under vacuum while microwave is applied under the following stages:

1. Drying and oxygen removal up to a temperature of 180 C.
2. Treatment under vacuum where the microwaves carry out depolymerization of the long chain hydrocarbons in the volatile matter to produce more short chain hydrocarbon molecules, and
3. Pyrolysis under vacuum up to a temperature of 720 C. Some coals are adequately pyrolyzed at about 450° C.

As light oil is being produced in the three stages above during the process, light oil is being volatilized during the three stages above, with more oil being produced at the higher temperatures. This was observed during the experiments.

The screw reactor has arms or lifters to turn the coal to allow uniform exposure to the microwave energy while at the same time move the coal mass towards the discharge end of the reactor. Means of feeding and discharging the coal such as star feeders to maintain the vacuum are provided. The exhaust gas is cooled and condensed to recover any liquid while the gas may be partly recycled for use in the process and mostly dispatched to the power plant for use in power generation.

The treatment steps 1 to 3 above would be the average proposed for a particular coal but coal characteristics vary and some coals after testing may require steps 1, 2, and 3 or even simply step 3 only with some grinding and screening of the raw coal. It is observed that the coal degrades in size during the process due to either chemical breakdown of the particles during the process or attrition caused by the stirred reactor. It is important to carry out tests on each coal to determine the best treatment option to produce the largest amount of light crude oil.

The hot gas produced in the pre-treatment and microwave pyrolysis is condensed by indirect condensers or direct injection of cold water. There may be several condensers cooling at different temperature to recover efficiently the different kinds of oil produced from the light oil to the waxy type hydrocarbons. The water may also contain a solvent to dissolve the oil in the hot gas where the oil is recovered later by distillation.

Figure 6:
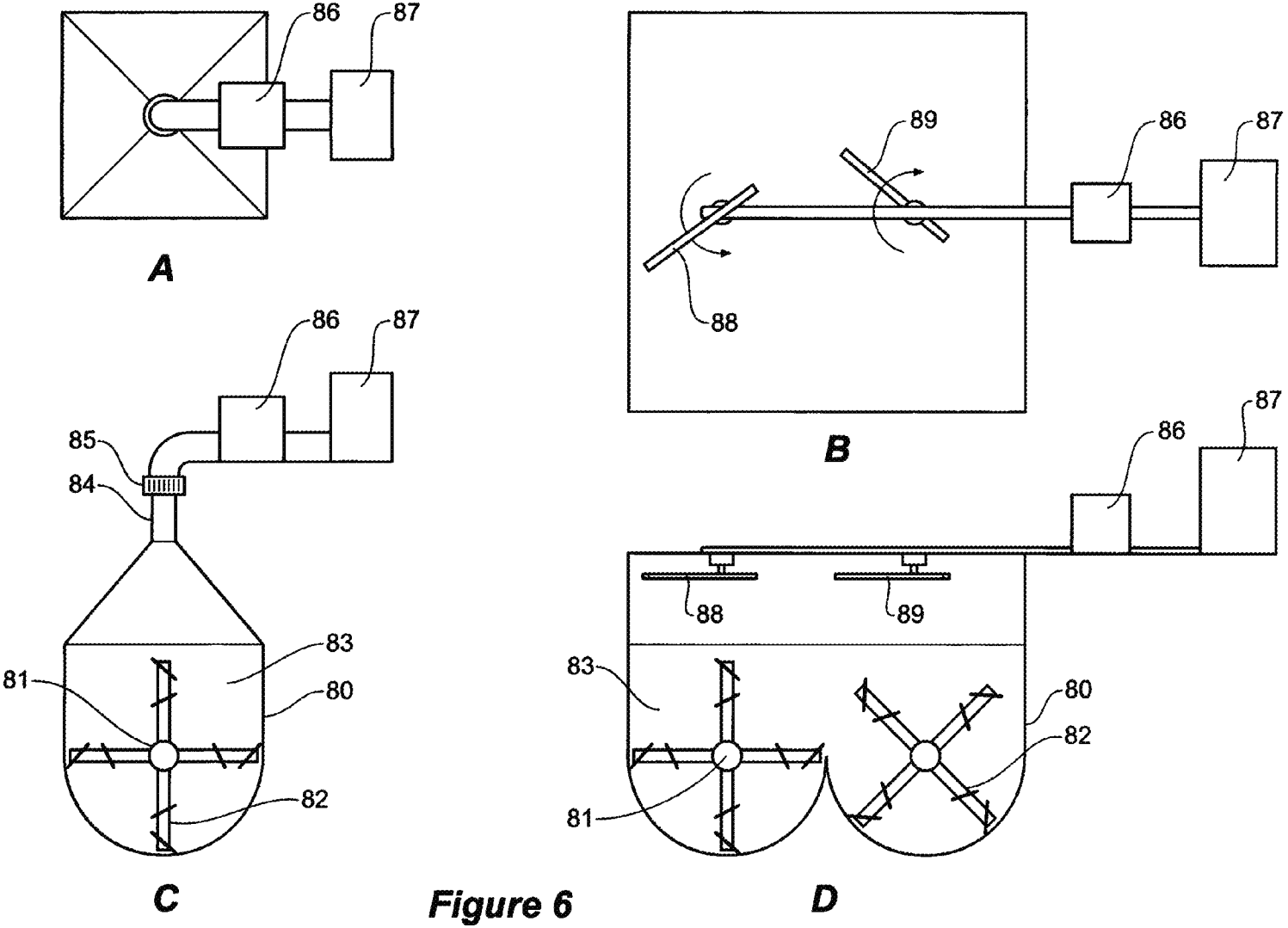
FIGS. 6 A to D show some of the microwave systems according to embodiments of the present invention.

Microwaves at a single frequency from 2.45 GHz to 300 GHz and with a pulsing rate of 1 to 50 kilohertz may be applied on the fine coal in the stirred bed by overhead feed pipes or by overhead rotating antennae as shown on FIGS. 6

A to D. FIG. 7 shows a screw stirred bed reactor where the microwave is fed through the screw shaft with windows along the shaft to distribute the microwave to the coal load. FIG. 7 also shows an offset shaft to allow better movement of the coal.

FIGS. 6 A to D depict some of the microwave systems that may be used in my oil from coal process. The simplest method is where the microwave is generated by magnetron 87 and passed through tuner 86 before being fed through microwave window 85 and circular wave guide 84. The microwave may be converted to circular polarisation after passing the tuner 86 by a twisted wave guide. The reactor 80 heated externally contains the fine coal 83 that is continuously stirred by a rotating shaft 81 with arms fitted with vanes 82. The reactor may also include heating by tubes within the reactor where hot gas is passed through. The microwave may also be applied to the stirred coal 83 in reactor 80 by rotating microwave antennae 88 and 89 inside the reactor 80 but above the coal bed 83. The microwave is applied mechanically in a rotating fashion inside the reactor 80 as described but the microwave may also be applied electronically in a rotating form inside the reactor 80.

Figure 7A:
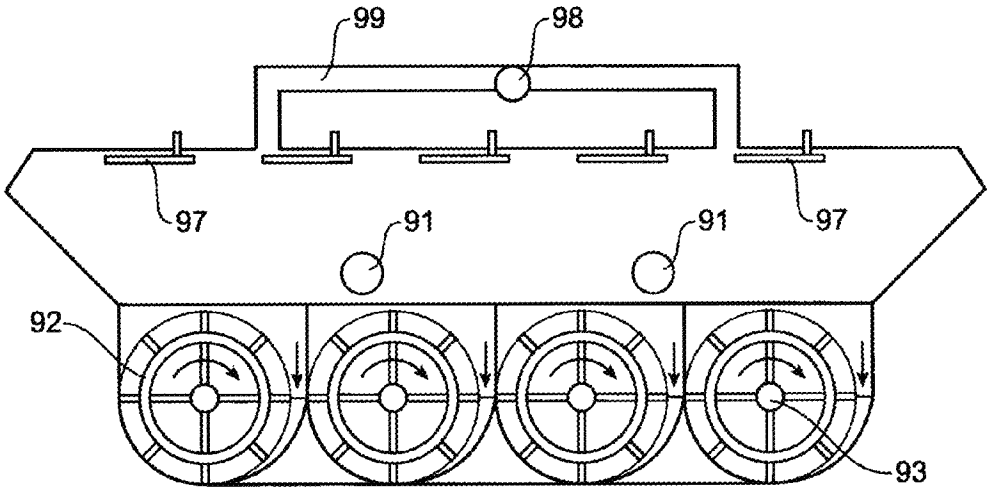
FIGS. 7A and 7B show a commercial screw stirred bed reactor with off-set centre shaft according to an embodiment of the present invention.
Figure 7B:
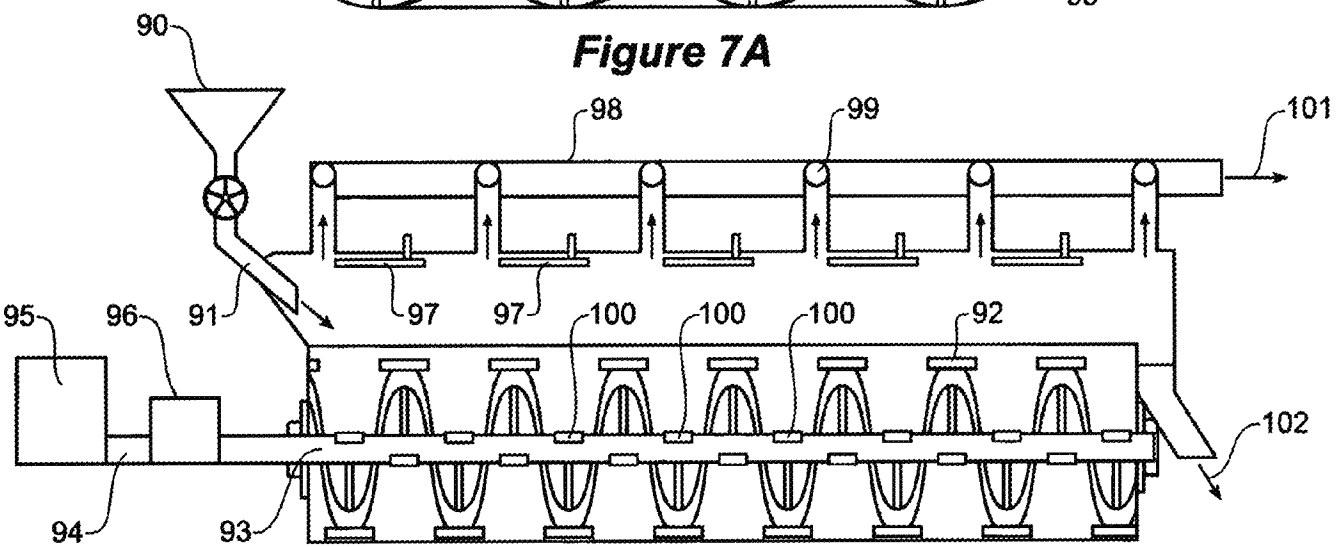

FIGS. 7A and 7B show a commercial screw stirred bed reactor with off-set centre shaft. Fine coal 90 is fed through a star feeder through a feed chute into the reactor 91 where the coal bed is stirred continuously by rotating arms 92 which feed the coal slowly towards the discharge 102. The surface of the coal bed is irrigated with microwaves from the rotating antennas 97 and the hot gas is collected at the top of the reactor 91 by a series of pipes 98 and 99 with the hot gas 101 delivered to solid separators and condensers. Note that the screw shaft 93 is located off-centre to encourage the movement of the coal as shown by the arrows. Some of the microwave generated by magnetron 95 through wave guide 94 through tuner 96 may be fed to the coal bed through windows 100 in the centre shaft 93. The reactor 91 is externally heated by flue gas or heater using some of the gas produced in this oil from coal process.

Figure 8:
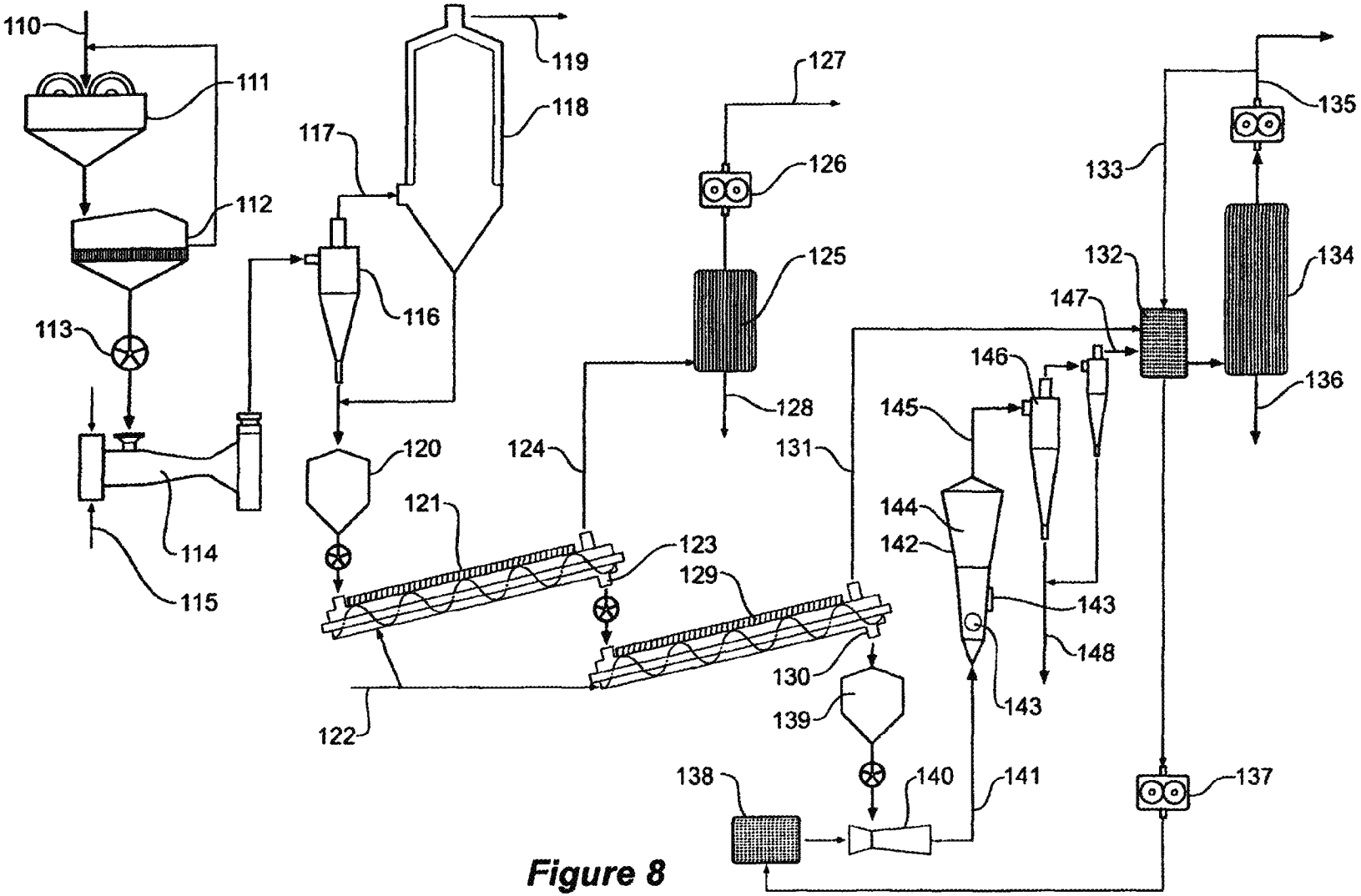
FIG. 8 shows an alternative embodiment of a commercial process according to the present invention.

FIG. 8 shows a dry process where the fine coal is treated for oxygen removal and pre-treatment but the pyrolysis is carried out in a dilute phased fluidized system. The purpose of this process is that pyrolysis is carried out quickly which in certain instances would result in higher oil production. After pyrolysis, the solids are separated from the hot gas by cyclones before the gas is condensed.

FIG. 8 shows a commercial stirred bed process where the pyrolysis step is carried out in a dilute phase fluid bed. Run of mine coal 110 is crushed in roll crusher 111 and then screened on screen 112 before feeding into an intense vortex comminutor 114 through feeder 113. The fine coal is fed to cyclones 116 with the overflow 117 going into bag house or electrostatic precipitator or wet cyclone scrubber 118 with clean air 119 exiting into the atmosphere. In many coals, hydrocarbon gas is produced upon grinding; therefore, where appropriate, the gas 119 should be used as the air feed into the boiler for environmental reasons and higher thermal efficiency of the system.

The fines from the bag house or electrostatic precipitator join the cyclone underflow to storage bin 120 before feeding through a star feeder into screw stirred rector 121 where drying and oxygen removal is carried out. The hot gas 124 is mostly moisture and is delivered to the condenser 125 where the condensate 128 is recovered which may contain a little amount of oil that may be recovered. The gas 127 is passed through vacuum pump 126 which may be used as fuel if it contains hydrocarbon gases, otherwise, it is discharge to atmosphere. The dry coal 123 from reactor 121 is fed through star feeders into reactor 129 for pre-treatment with some crude oil production with the hot gas 131 delivered to heat exchanger 132 before feeding into condensers 134 to produce condensates 136 and cool gas 135. Part of gas 135 is passed through heat exchanger 132 before pump 137 puts it through heater 138 to a temperature between 350 C an 450 C and then through the venturi 140 which is fed the pre-treated coal 130 from storage bin 139. The hot gas-fine coal mixture 141 is fed at the bottom of the dilute phase fluidized bed 142 where microwaves are fed at different windows 143 to achieve a temperature of up to 650 C before the coal leaves the reactor 142. The reactor 142 has increasing cross-sectional area from bottom to the top of the reactor and is externally heated and insulated and made of 304 stainless steel which does not absorb microwave energy. 304 SS is the choice material where microwaves are applied to the reactor. The hot gas-coal mixture 145 is passed through cyclones 146 where the solids are sent to the power plant or to up-grading while the hot gas 147 is sent to the heat exchanger 132 and condensers 134 to recover the crude oil. The unused gas 135 is sent to the power plant.

Figure 9:
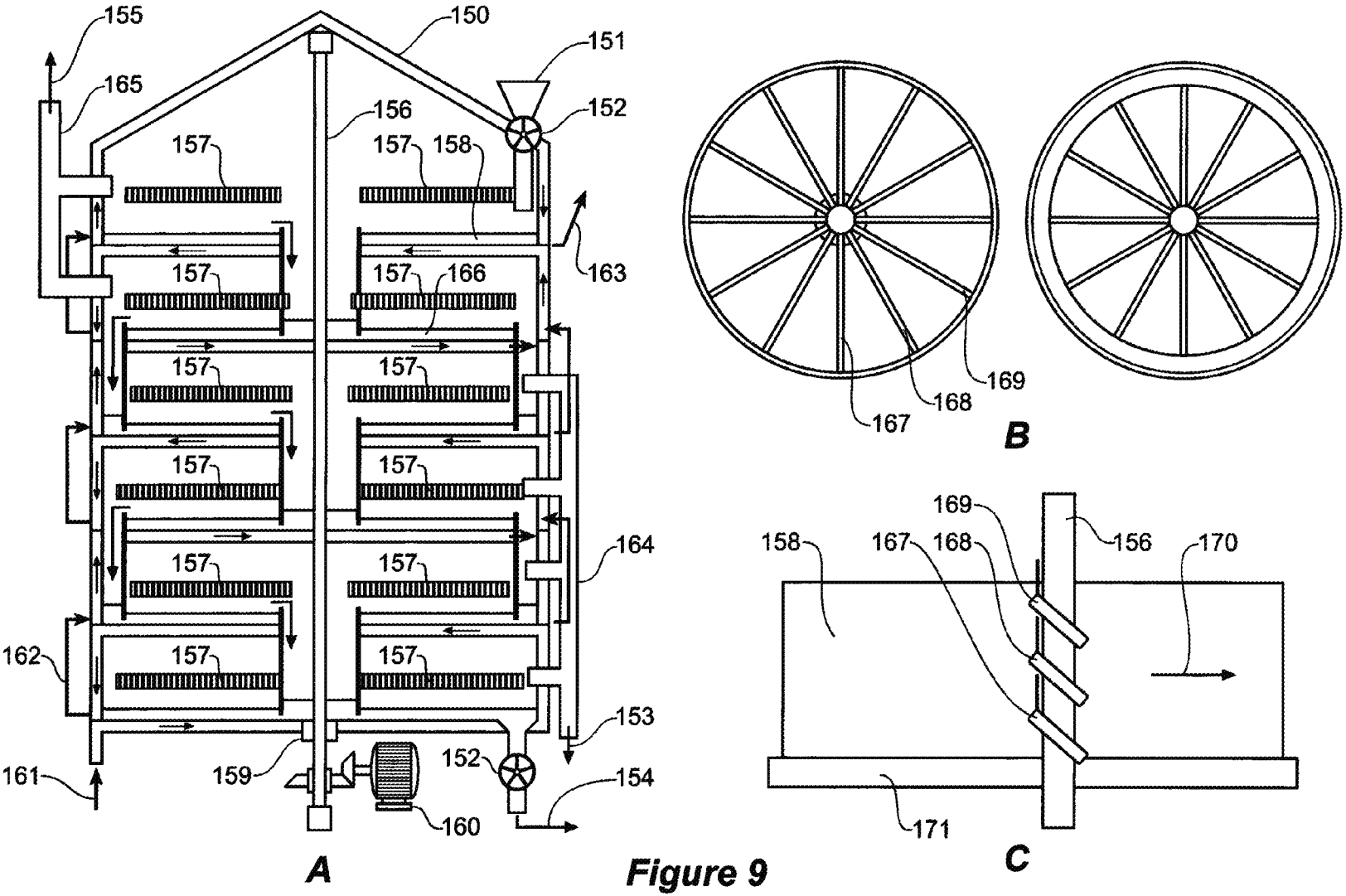
FIGS. 9 A to C show a Herreshof type microwave vertical stirred reactor according to an embodiment of the present invention.

Another commercial type reactor capable of carrying out my process is the Herreshoff type multiple hearth vertical furnace equipped with rotating arms at each hearth driven from a central shaft as shown on FIGS. 9 A to C. Vacuum is maintained by star feeder of the coal at the top of the furnace and another star feeder to remove the residue from the bottom of the furnace. Vacuum lines at the upper end of the furnace collect the moisture while vacuum lines at the lower end of the furnace collect the hot gas and deliver these to the condensers. The furnace is heated by hot gas circulating at the sides and floors while microwaves are delivered over the hearths either by electronic or mechanical rotating antennas.

The rotating arms over the hearths turn the fine coal from bottom to the top of the bed to provide maximum and uniform exposure of the fine coal to the microwaves as the coal travels inwards and outwards at alternate hearths.

FIGS. 9 A to C show a commercial Herreshof type reactor that was widely used for roasting minerals. Fine coal 151 is fed at the top section via star feeder 152 where the coal is spread over the bed 158 with microwave applied by windows or mechanical or electronic rotating antennas 157. Stirring arms 167, 168, and 169 connected to the centre shaft 156 stir the coal to expose fresh coal particles to the microwaves while at the same time moving the coal towards the centre where the coal drops into the second hearth. The stirring arms 167, 168, and 169 stir the coal to expose fresh coal particles and at the same time move the coal bed 166 toward the outer perimeter of the hearth where the coal drops to the next hearth and the coal is moved towards the centre of the hearth. Gas which is mostly moisture 155 is drawn from the upper hearths by pipes 165 and delivered to condensers. Hot gas 153 containing the oil is drawn from the lower hearths by pipes 164 and sent to condensers. The centre shaft is driven by motor 160 through seals 159. Hot gas 161 is circulated through out the external and hearths of the reactor and the heating gas 163 exits from the reactor. The reactor is kept under vacuum and the residue is discharged through valve 152 at the bottom of the reactor and the residue 154 is sent to the power plant as fuel or for further up-grading.

Figure 10:
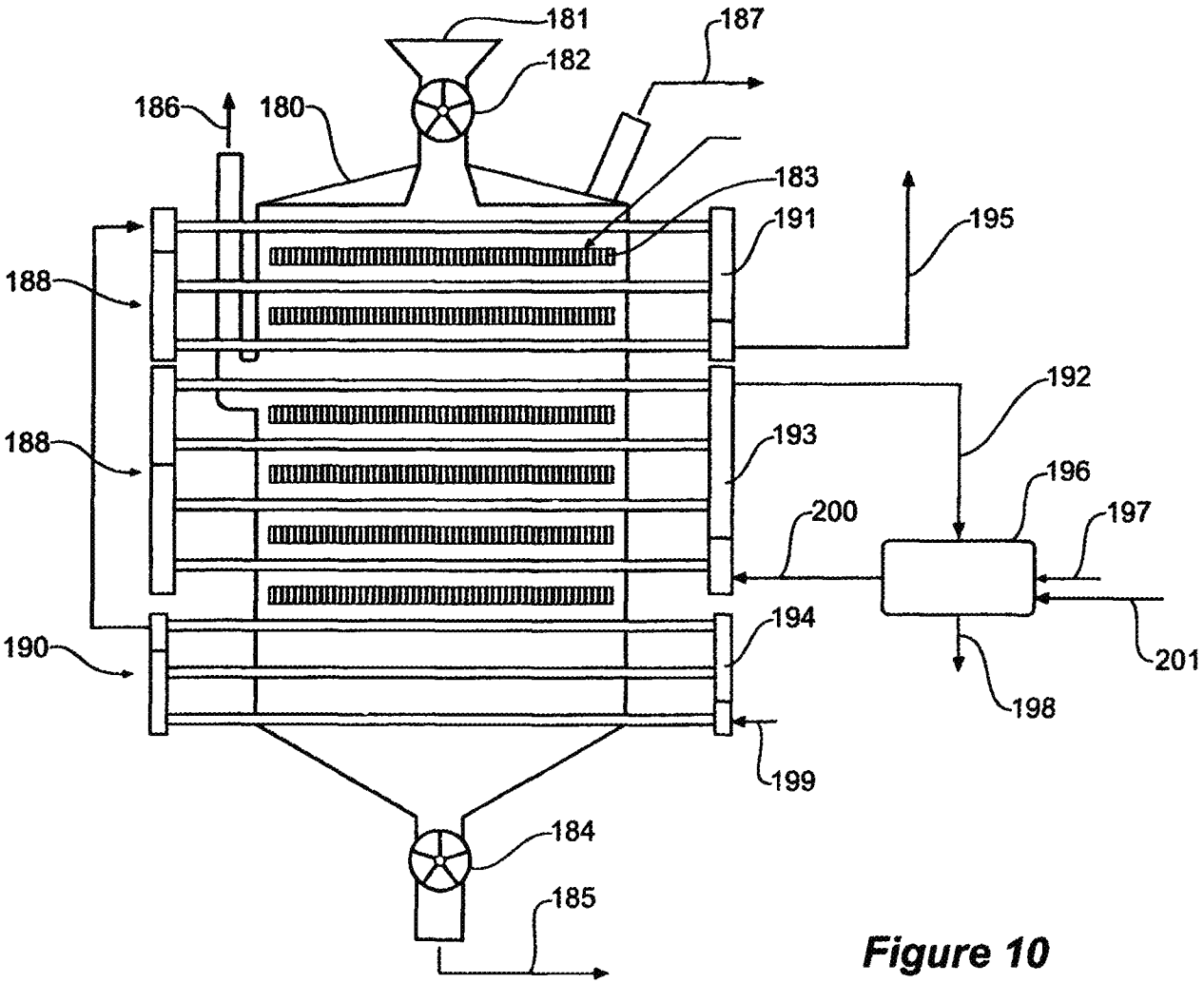
FIG. 10 shows a commercial straight vertical furnace reactor according to an embodiment of the present invention.

FIG. 10 shows a vertical furnace where the fine coal is preheated and pyrolyzed under vacuum as it travels from the top of the furnace to the bottom where the residue is removed via star feeders. Heat is provided by a furnace burning the hydrocarbon gas from the process and by microwave energy delivered by waveguides or electronic antenna inside the furnace. Some recuperation of the heat is possible with this furnace. The advantage of this furnace is its simplicity. Moisture is collected at the top of the furnace while hot gas containing the oil and hydrocarbon gas is collected at lower portions of the furnace.

In FIG. 10 the reactor 180 is divided into the preheating zone 188, the pyrolysis zone 189 and the recuperation zone 190. Fine coal 181 is fed at the top of the reactor 180 through a star feeder 182 with the coal acted upon by microwaves 183 and conventional heat 191. Moisture 187 is extracted at the top of the reactor and sent to condensers. As the fine coal 181 travel downwards in the reactor 180, the coal is increasing heated to pyrolysis temperature by microwaves 183 and conventional heat 200 produced from heater 196 using gas fuel 201 and air 197 with heat recuperated from gas stream 192. At the lower part of the reactor, heat is recovered by heat transfer tubes 194 from gas 199 which could be gas 198 and the heated gas is transferred to heat exchanger 191. The residue is passed through valve 184 at the bottom of the reactor 180 and the residue 185 is sent to power plant or further up-grading.

Figure 11:
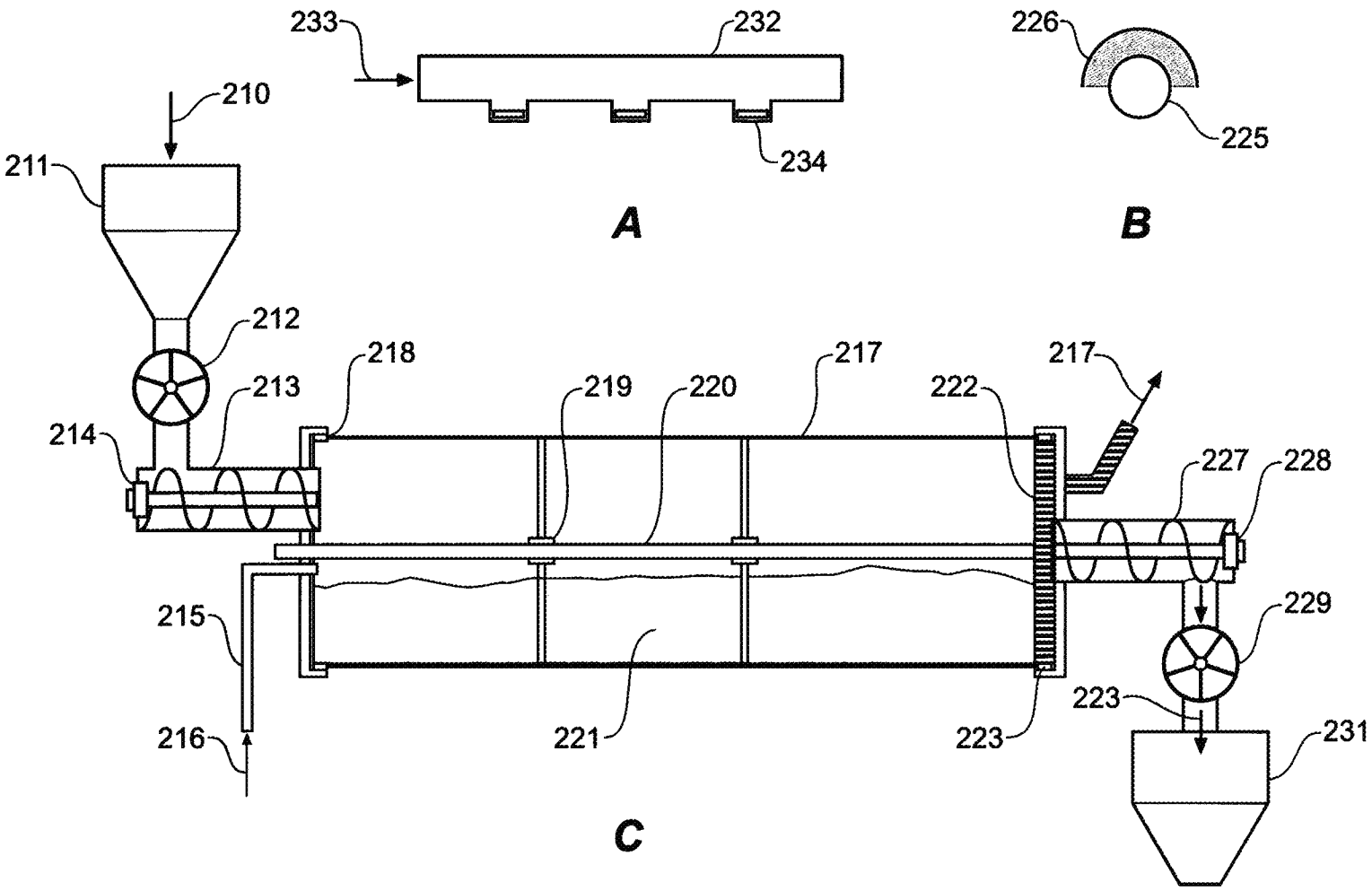
FIGS. 11 A to C show a rotary kiln according to the present invention.

FIGS. 11 A to C show a rotary kiln that receives fine dry coal for pyrolysis under vacuum using pulsing microwaves. The microwave antenna is located at the centre of the kiln with a reflector to direct the microwaves to the coal at the lower part of the kiln. Star feeders are used for the coal feed and valve lifter and screw feeder discharges the residue from the rotary kiln through a star feeder.

In FIGS. 11 A to C the rotary kiln is a commercial reactor that is externally heated where electromagnetic energy of microwave or radio frequency is applied to the fine coal mass to extract oil from coal under vacuum. Fine coal 210 is fed from bin 211 through star feeder 212 into a screw feeder 213 feeding the coal into the rotary kiln 217. A microwave antenna or radio frequency antenna 220 at the middle of the rotary kiln and supported by bearing 219 is installed at the middle of the rotary kiln. Some reducing gas 216 may be introduced through pipe 215 into the kiln. The antennae 225 may be fitted with a reflector 226 to direct the electromagnetic waves to the coal mass 221. The residue is discharged through a valve lifter 222 into screw feeder 227 with seal and drive 228 discharging into star feeder 229 and the residue 230 is stored in bin 231. There may be several rotary kiln reactors carrying out drying and oxygen removal, pre-treatment, and pyrolysis.

Another potentially successful commercial reactor for the present invention is a flat table reactor equipped with rotating vanes connected to travelling chains to stir the fine coal as the coal is moved from the feed end to the discharge end under vacuum. Aside from the star feeders at the feed and discharge, only one side of the drive shaft need to be sealed to maintain the vacuum in the reactor. Microwaves are applied above the coal bed by rotating mechanical or electronic microwave antennas and the hot gas is drawn from the top of the bed by several discharge pipes. One reactor may carry out oxygen removal and drying, another reactor for pre-treatment, and another reactor for pyrolysis.

Figure 12:
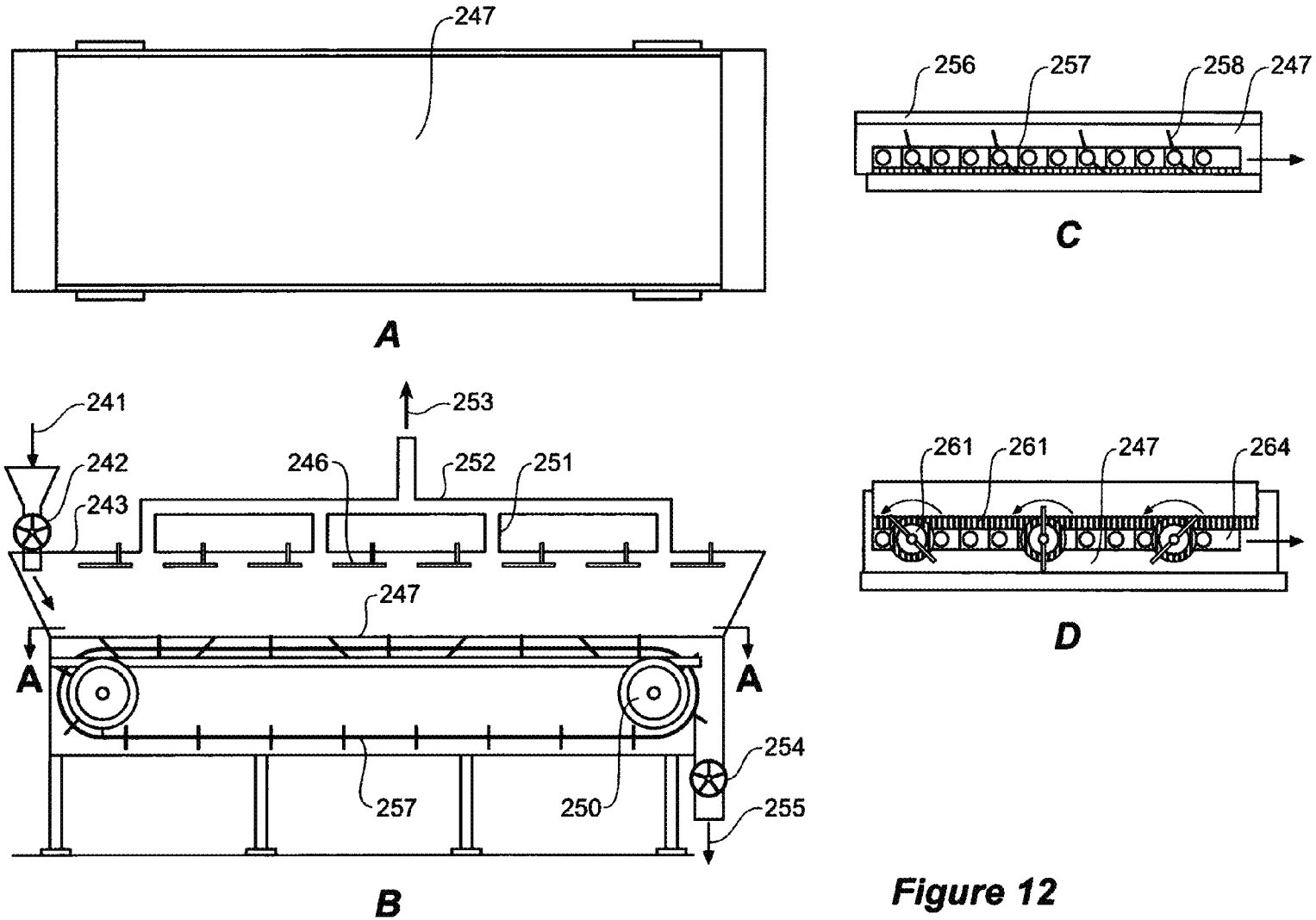
FIGS. 12 A to D show a flat table conveyor reactor according to the present invention.

In FIGS. 12 A to D there is shown a flat table conveyor reactor with the bed material made from metal or ceramic that can stand up to temperature up to 720C. Fine coal 241 is fed by valve feeder 242 into reactor 243 forming a bed 247 bounded by sides 256. A double chain 257 is pulled continuously by drive sprocket 250 provided with fixed vanes 258 to turn the coal bed over to expose fresh coal to the microwaves radiated above by antennas 246. The coal may also be turned over by rotating vanes 261 connected to rack gears 262 as the chain 264 is travelled forward. The hot gas 253 is collected by overhead pipes 251 and 252 for delivery to the condensers. The residue 255 is discharged at the end of the conveyor through rotary valve 254.

Our preliminary testing indicates that gas is produced during the pyrolysis but at a certain temperature, there is a sudden large production of gas. This will cause instability in a dense bed fluidization reactor and will blow the fine coal dust to the gas discharge of the fluid bed reactor.

Figure 13A:
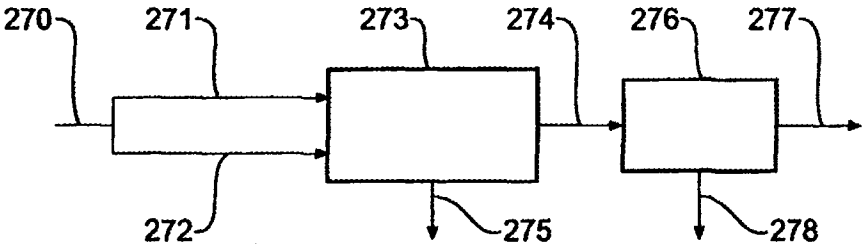
FIG. 13A shows schematically an existing brown coal power plant.

FIG. 13A shows schematically an existing brown coal power plant and FIG. 13 B shows how the process of the present invention can be installed in an existing brown coal power plant The existing power plant is shown on FIG. 13A where coal 270 containing volatile matter 271 and fixed carbon 272 is fed to the power plant 273 which produces electricity 275 and the flue gas 274 is fed to the electrostatic separator 276 recovering the ash 277 and discharging the flue gas with carbon dioxide 278 to the atmosphere.

Figure 13B:
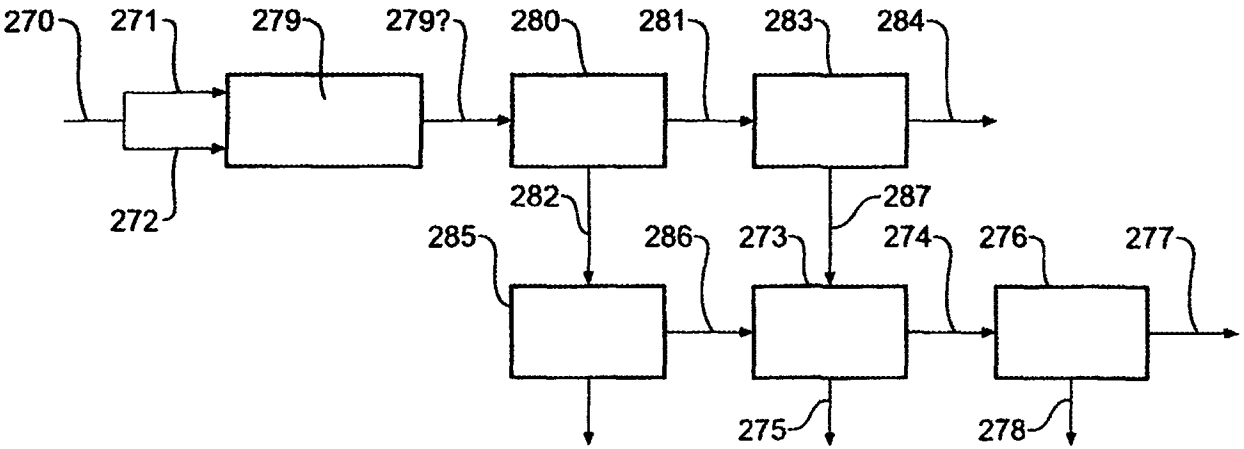
FIG. 13 B shows how the process of the present invention can be installed in an existing brown coal power plant.

FIG. 13B shows the coal upgrading process according to one embodiment of the present invention installed in an existing power plant. Fine brown coal 270 ground by a gas vortex comminutor containing the volatile matter 271 and fixed carbon 272 is fed to my oil from coal process 279 producing a hot gas-solid stream 279 that is passed to solid separator 280 with the solids 282 containing the fixed carbon 286 is fed to the power plant 273. The hot gas 281 is condensed in condensers 283 producing the crude oil 284 and hydrocarbon gas 287 that is fed to the power plant 273. The power plant produces the electricity 275 and the flue gas 274 fed to the electrostatic separator 276 recovering the ash 277 and discharging the flue gas 278 with the carbon dioxide to the atmosphere.

One advantage of my dry oil from coal process for brown coal power plants that use virgin brown coal with 60% moisture is that the residue is high carbon material with very low moisture. This will improve the electrical efficiency of the brown coal power plants provided the boilers are changed to accommodate the high calorific value residue.

Tests also indicate that during microwave pyrolysis, some of the ash content of the coal is expelled from the carbon crystal lattice and makes it possible to produce a high carbon product (after recovering the oil) that is suitable for steel making. For example, Victorian brown coal that has about 57% total carbon can be up-graded to 86% carbon by grinding and flotation of the residue. It is believed that higher carbon material is possible.

Coal power plants particularly those using brown coal with moisture as high as 60% are major carbon dioxide polluters. It is appropriate to demonstrate how the process of the present invention can be integrated with carbon sequestration using activated seawater as discussed in PCT/AU2008/000211 "Carbon Dioxide Sequestration and Capture".

Grinding brown coal with 60% moisture is difficult by conventional grinding method but by use of the intense gas vortex comminutor discussed above the brown coal is easily ground to a fine size while removing about 14% moisture from the fine coal. Many coals produce hydrocarbon gas when exposed to the atmosphere and particularly when ground to a fine size. To prevent this hydrocarbon gas from polluting the atmosphere, in this invention, the gas from my intense vortex after solids removal, can be fed as the air in the boiler of the coal power station.

Figure 14:
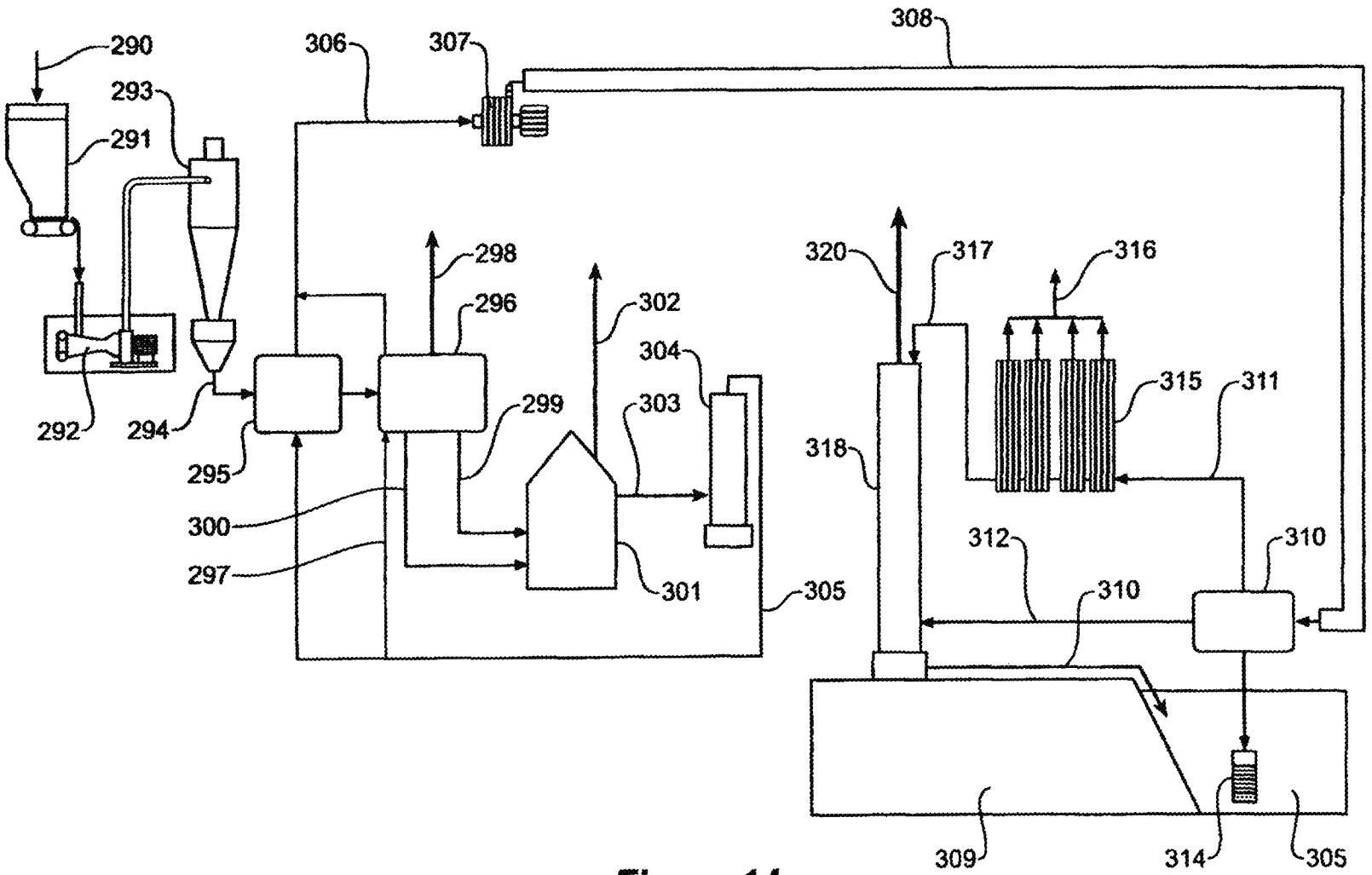
FIG. 14 shows a preferred embodiment of a commercial process according to the present invention incorporating sequestration of carbon dioxide.

Many coal power plants are located along sea coast to access cooling water and the application of my carbon sequestration using activated seawater is convenient; however, if the coal power plant is located inland, the flue gas containing the greenhouse gas emissions can be transported by pipeline to the sea as shown on FIG. 14. The power plant operator can readily justify the additional expense of sequestration from its substantial additional income from the oil from the coal.

FIG. 14 shows an inland power station fitted with the process of the present invention and the flue gas from that process is pumped to oceanside for the sequestration of carbon dioxide using the process of PCT/AU/2008/000211.

Crushed coal 290 is stored in bin 291 and fed into a vortex comminutor 292 with the products passed to solids separator 293 with the fine coal 294 passed through dryer 295 using flue gas 305 from the power plant 301. The fine dried coal is fed to the oil from coal process 296 according to the present invention producing crude oil and chemicals 298 and hydrocarbon gas 300 and carbon solids 299 that is fed as fuel to the power plant 301 where electricity 302 is produced and flue gas 303 fed to the electrostatic separator 304 to separate the ash and the hot flue gas 305. After the flue gas is used to dry the fine coal, the flue gas 306 is pumped by pump 307 via pipeline 308 to the heat exchanger 310 at oceanside before the cool flue gas 312 is delivered to the carbon dioxide absorption tower 318 where it is irrigated by activated seawater 317 from unipolar cells 315. As the seawater 311 is pumped through the unipolar cells 315, the seawater is made alkaline with hydrogen gas 316 produced. The flue gas 320 with much less carbon dioxide is discharged to atmosphere.

To deliver a higher electrical efficiency for a new coal power plant, it would also be possible to combine the oil from coal process of the present invention, PCT/AU2008/000211 for carbon sequestration, and U.S. Pat. No. 7,182,851 "Electrolytic Commercial Production of Hydrogen from Hydrocarbon Compounds".

After oil is extracted from the coal, the residue and the hydrocarbon gas produced is fed into my electrolytic process which produces pure hydrogen and pure carbon dioxide from the feed. The hydrogen may be feed to a combined cycle power plant as shown on FIG. 15 while the pure carbon dioxide is piped to the sea coast for sequestration using the unipolar activated seawater process discussed above.

Figure 15:
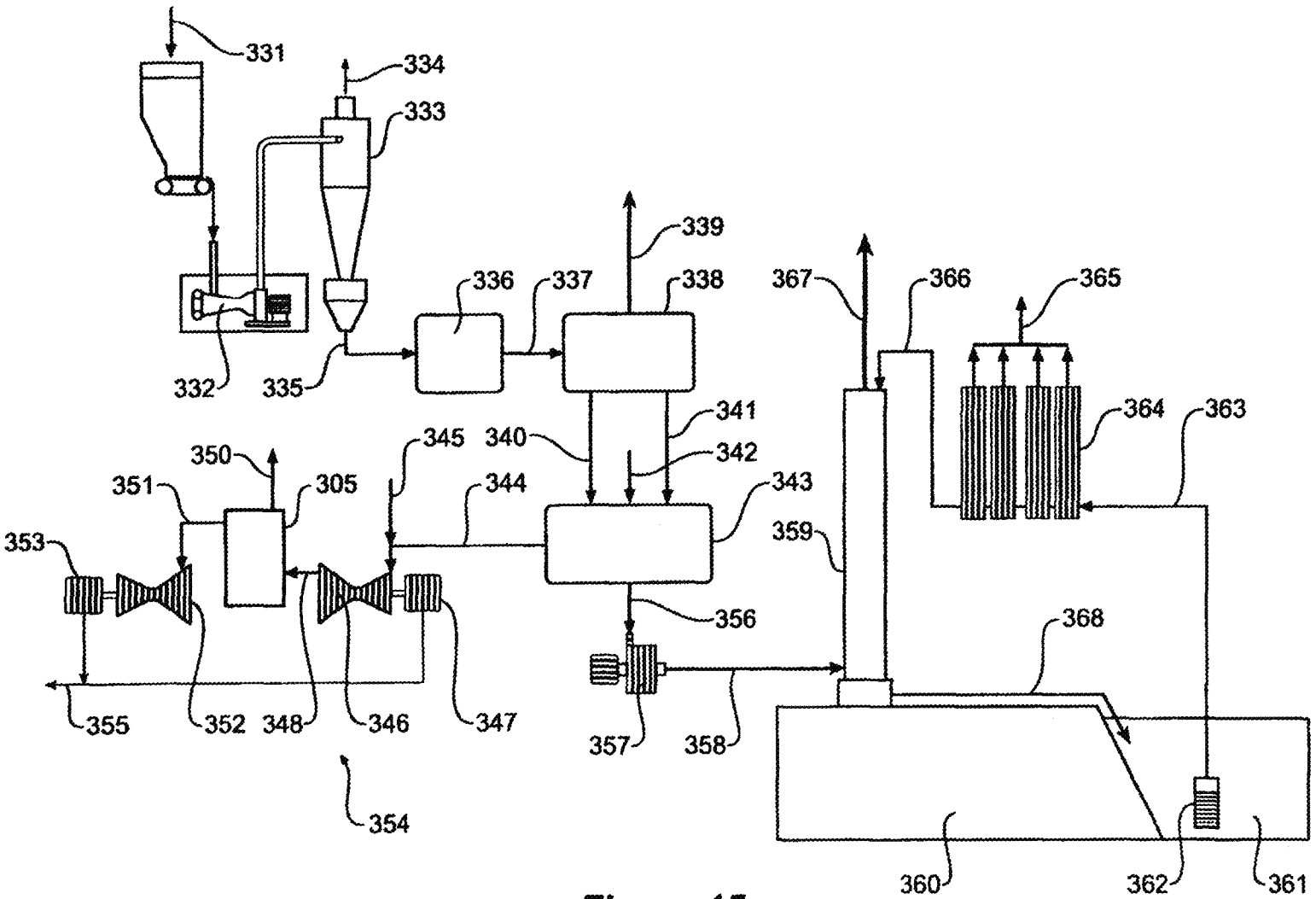
FIG. 15 shows a further preferred embodiment of a commercial process according to the present invention.

FIG. 15 illustrates the clean coal technology for an inland power plant 354 where crude oil is extracted from the coal and the residue and hydrocarbon gas produced are converted to pure hydrogen for use in a combined cycle power plant to produce electricity and the pure carbon dioxide is pumped to oceanside to be sequestered by a unipolar process. Crushed coal 331 is fed into a vortex comminutor 332 with the solids separated by solids separator 333 with fine coal 335 is dried in dryer 336 and the dried fine coal 337 is fed to my oil from coal process 338 producing crude oil and coal chemicals 339 and the carbon residue 340 and hydrocarbon gas 341 fed to an electrolytic coal to hydrogen process (U.S. Pat. No. 5,882,502) 343 with water 342 to produce hydrogen 344 and carbon dioxide 356. The hydrogen 344 is use as fuel with air 345 for gas turbine 346 driving generator 347 and the hot exhaust gas 398 is used to raise steam 351 in a boiler 349 to feed a steam turbine 352 that drives a generator 353 to produce electricity 355. The carbon dioxide 356 is pumped by pump 357 through pipeline 358 to the carbon dioxide absorption tower 359 at oceanside 360, where seawater 363 is passed through unipolar cells 364 producing hydrogen 365 and activated alkaline seawater 366 that is delivered to the top of the carbon dioxide absorption tower 359 to contact and sequester the carbon dioxide 356. The gas 367 containing much less carbon dioxide is discharged to the atmosphere.

The invention claimed is:

1. A coal or carbonaceous material upgrading process for power station use, the process comprising the steps of:

(a) comminuting the coal or carbonaceous material to a comminuted material;

(b) pre-treating the comminuted material in a first reactor with single frequency pulsed microwave energy and vacuum to reduce its water and oxygen content; the pre-treating stage being carried out at a temperature of up to 180° C.;

(c) transferring the pre-treated comminuted material to a second reactor;

(d) treating the pre-treated comminuted material in the second reactor with single frequency pulsed microwave energy under vacuum to produce volatile organic materials; the treatment stage being carried out at a temperature of over 180° C. and up to 350° C.;

(e) transferring the treated material from the second reactor to a third reactor;

(f) pyrolyzing the treated material in the third reactor with single frequency pulsed microwave energy and vacuum to produce a hot gas and a solid carbon residue; the pyrolyzing stage being carried out at a temperature of over 350° C. and up to 720° C.;

(g) separating the solid carbon residue from the hot gas;

(h) condensing the volatile organic materials and hot gas to produce a liquid hydrocarbon product and a gas product; and (i) feeding the solid material and the gas product to a power station to produce electricity therefrom.

2. A process as in claim 1 where the coal or carbonaceous material is comminuted in an intense gas vortex comminutor to produce a fine coal feed to the microwave process of 50 to 150 microns.

3. A process as in claim 1 where the comminuted material is pre-treated in the first reactor under a high vacuum to reduce the oxygen content.

4. A process as in claim 1 where first reactor comprises a stirred bed reactor.

5. A process as in claim 1 wherein the treatment step in the second reactor comprises a high vacuum.

6. A process as in claim 1 where the pyrolysing step in the third reactor comprises a high vacuum to extract oil and gas.

7. A process as in claim 1 where third reactor comprises an apparatus selected from a stirred bed reactor or a dilute fluidized reactor.

8. A process as in claim 1 where the hot gases after solids removal are condensed by an indirect method or by direct cooling with water, or an oil or a gas.

9. A process as in claim 1 wherein the solid material from step (g) is processed by grinding and flotation to remove incombustible particles therefrom before step (i) to produce a higher carbon content power station feed material and a high ash product.

10. A process as in claim 1 where the microwave applied at each of the stages has a single frequency of 100 megahertz to 300 gigahertz and is pulsed at a frequency of 2 to 50 kilohertz.

11. A process as in claim 1 where the pressure is a vacuum up to minus 95 kilopascals during the pre-treatment step, the treatment step, and the pyrolysis step.

12. A process as in claim 1 wherein each of the first reactor, the second reactor and the third reactor comprise an apparatus selected from a screw stirred reactor, a rotary kiln, a flat drag conveyor, a vertical Herreshof type kiln, or a stirred reactor feeding a dilute fluidized system.

13. A process as in claim 1 wherein the coal or carbonaceous material comprises oil shale.

14. A process as in claim 1 wherein the microwave energy in the first reactor is supplied as a pulsing single frequency, circular polarised, microwave energy.

15. A process as in claim 1 wherein the microwave energy in the second reactor is supplied as a pulsing single frequency, circular polarised, microwave energy.

16. A process as in claim 1 wherein the microwave energy in the third reactor is supplied as a pulsing single frequency, circular polarised, microwave energy.

* * * * *